US007052053B2

(12) United States Patent
Hall et al.

(10) Patent No.: US 7,052,053 B2
(45) Date of Patent: May 30, 2006

(54) LOAD FLOOR LATCH

(75) Inventors: Matthew Hall, Worcester (GB); Paul Soldo, East Windsor, NJ (US); Kevin A. McCloskey, Hatboro, PA (US); David Milne, Lima, NY (US); Andrew Thornton, Kingswinford (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/937,977

(22) Filed: Sep. 11, 2004

(65) Prior Publication Data

US 2005/0099019 A1 May 12, 2005

Related U.S. Application Data

(60) Provisional application No. 60/502,090, filed on Sep. 11, 2003.

(51) Int. Cl.
*E05C 19/10* (2006.01)

(52) U.S. Cl. ..... 292/126; 292/52; 292/200; 292/217; 292/226; 292/336.3; 292/DIG. 11; 292/DIG. 30; 292/DIG. 31; 292/DIG. 51

(58) Field of Classification Search ..... 292/126, 292/52, 200, 203, 217, 226, 336.3, DIG. 11, 292/DIG. 30, DIG. 31, DIG. 61, DIG. 51
See application file for complete search history.

(56) References Cited

U.S. PATENT DOCUMENTS 947,528 A * 1/1910 Hunter ..... 292/173
1,929,775 A * 10/1933 De Voe ..... 292/226
2,186,903 A 1/1940 Gleason
2,649,322 A * 8/1953 Mack ..... 292/173
2,763,503 A 9/1956 Tasch et al.
2,874,986 A * 2/1959 Henrichs ..... 292/167
2,987,908 A 6/1961 Pelcin
3,494,650 A 2/1970 Slopa
3,495,862 A 2/1970 McClintock
3,743,336 A 7/1973 Andrews
3,758,140 A * 9/1973 Prete, Jr. ..... 292/223
3,782,141 A 1/1974 Doerrfeld
4,138,869 A 2/1979 Pelcin
4,186,952 A 2/1980 Glass
4,322,958 A 4/1982 Eigemeier
4,492,396 A 1/1985 Luke et al.
4,542,924 A 9/1985 Brown et al.
4,638,649 A 1/1987 Chao
4,650,230 A 3/1987 Takasaki
4,683,736 A 8/1987 Weinerman et al.
4,687,237 A 8/1987 Bisbing
4,693,503 A * 9/1987 Bisbing ..... 292/210
4,704,882 A 11/1987 Takasaki
4,763,935 A * 8/1988 Bisbing ..... 292/66
4,778,207 A * 10/1988 Gergoe ..... 292/336.3
4,813,722 A * 3/1989 Viscome et al. ..... 292/216
4,969,916 A 11/1990 Weinerman et al.
5,046,340 A 9/1991 Weinerman et al.

(Continued)

*Primary Examiner*—Brian E. Glessner
*Assistant Examiner*—Carlos Lugo
(74) *Attorney, Agent, or Firm*—Paul & Paul

(57) ABSTRACT

A load floor latch for securing a first closure member to a second closure member. The latch is opened by actuating a handle and a pawl supported on the housing is pivoted away from a keeper on the second closure member by the actuation of the pawl by the handle which is biased to the closed position. The pawl is biased to the closed position. The pawl projects through an opening on the latch housing and also has a pawl projection which is guided during pivoting of the pawl by a portion of the exterior surface of the housing of the latch.

16 Claims, 28 Drawing Sheets

U.S. PATENT DOCUMENTS 5,292,159 A * 3/1994 Sandhu et al. ..... 292/173
5,301,989 A 4/1994 Dallmann et al.
5,326,141 A 7/1994 Gorman
5,340,174 A 8/1994 Bender et al.
5,413,391 A 5/1995 Clavin et al.
5,484,178 A 1/1996 Sandhu et al.
5,609,373 A * 3/1997 Gromotka ..... 292/229
5,630,630 A * 5/1997 Price et al. ..... 292/128
5,689,980 A 11/1997 Weinerman et al.
5,782,510 A * 7/1998 Gass ..... 292/165
5,820,175 A 10/1998 Clavin
5,927,772 A * 7/1999 Antonucci et al. ..... 292/336.3
5,927,773 A 7/1999 Larsen et al.
6,048,006 A * 4/2000 Antonucci et al. ..... 292/336.3
6,053,070 A * 4/2000 Tieu ..... 74/548
6,109,669 A * 8/2000 Pinkow ..... 292/175
6,116,660 A * 9/2000 Langkamp et al. ..... 292/65
6,203,077 B1 3/2001 Schlack
6,460,902 B1 * 10/2002 Kyle ..... 292/165
6,474,703 B1 * 11/2002 Berg ..... 292/200
D475,602 S 6/2003 McCloskey
6,626,472 B1 * 9/2003 Berg ..... 292/336.3
6,719,332 B1 * 4/2004 Sekulovic ..... 292/170
6,786,518 B1 9/2004 Vitry
2005/0093304 A1 5/2005 Figge et al

* cited by examiner

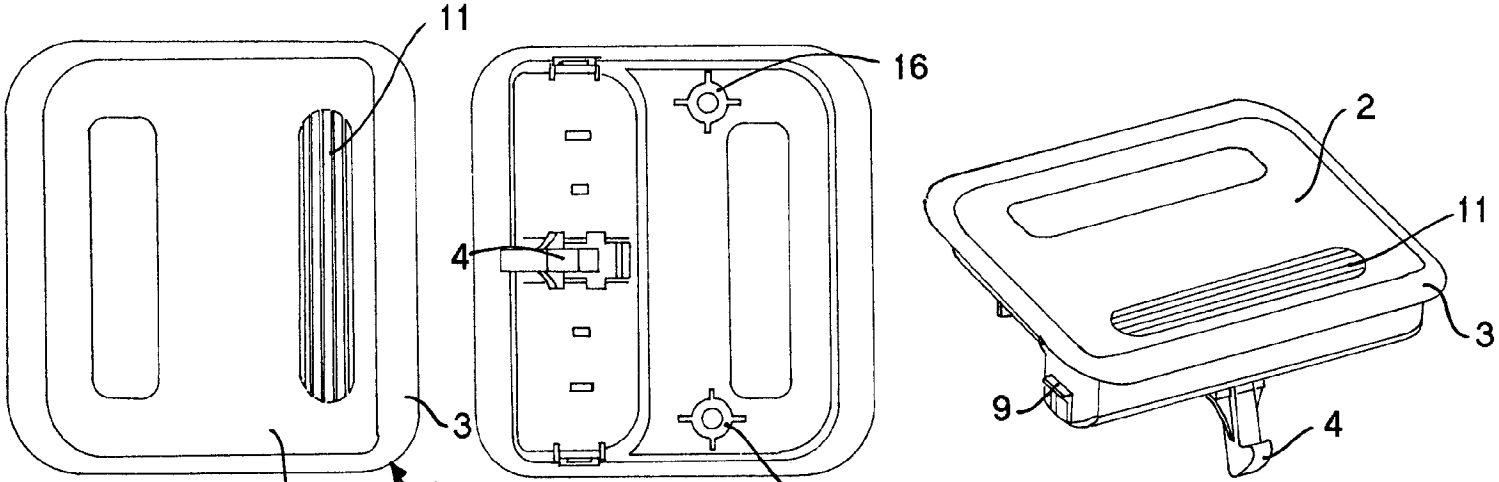
Fig. 1
Fig. 2
Fig. 5
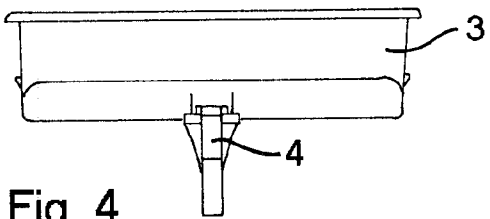
Fig. 4
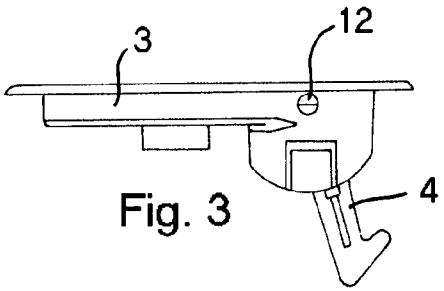
Fig. 3

14
4
10
19

14
4
10

5
13
14
4
10

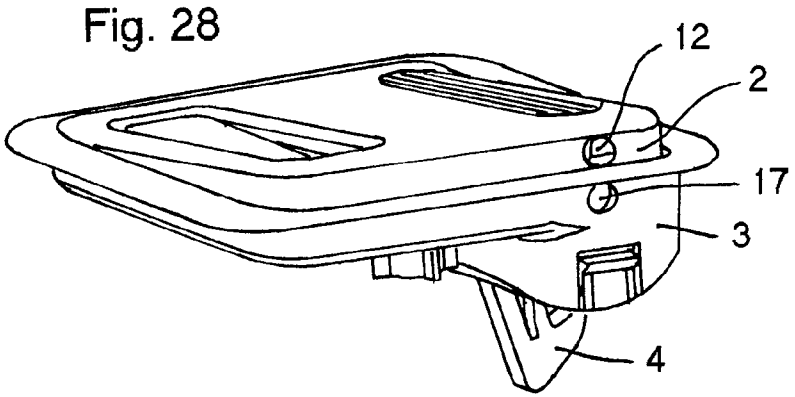
Fig. 28
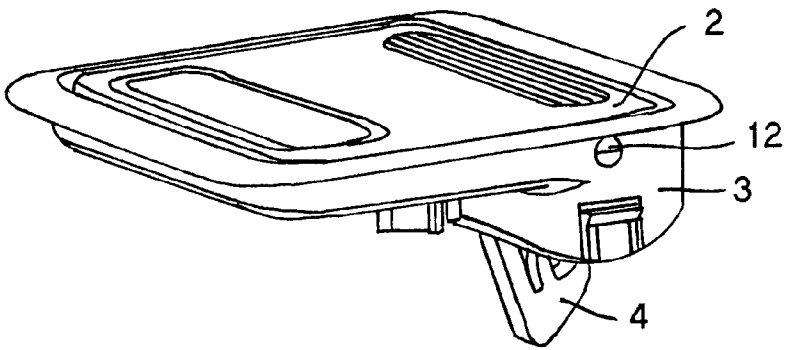
Fig. 29
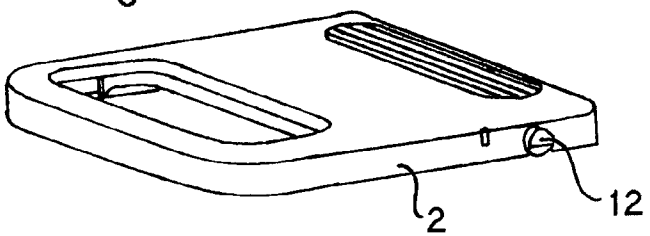
Fig. 27
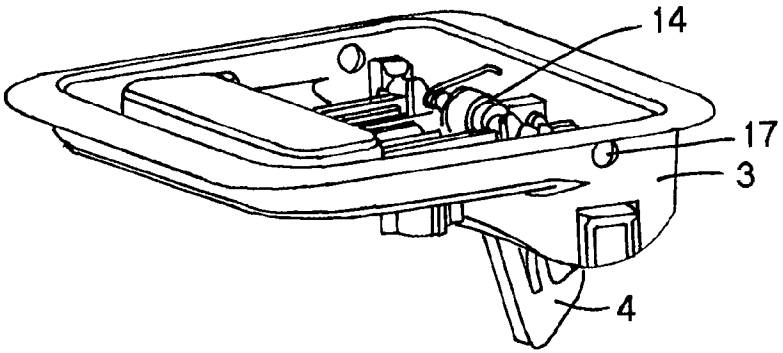

LOAD FLOOR LATCH

CROSS-REFERENCE TO RELATED APPLICATIONS

The applicants claim priority to U.S. Provisional application 60/502,090 filed Sep. 11, 2003 entitled Load Floor Latch, the entire specification of which is incorporated by reference.

BACKGROUND OF THE INVENTION

The present invention relates to the field of latches and more particularly to load floor latches in which a handle is lifted to release the latch from engagement with a keeper.

Load floor latches are known in the art and are employed in a number of applications. Generally, latches in this category operate by forcing a pawl into engagement with a keeper. For example, where a first closure member has a pawl and a second closure member has a keeper thereon closing first closure member against the second closure member secures the closure members. The latch can be repeatedly latched and unlatched by a user who desires to fasten and unfasten the first closure member to the second closure member.

One drawback with the previous load floor latches was that the pawl of the latch needed to slide into position and engage a keeper. Sliding type pawls in load floor latches did not positively engage keepers on the vehicles to the degree desired by a user.

A need exists for a latch which positively engages a keeper by the rotation of a pawl towards the keeper.

In addition, load floor latches, which is one application for the latches of the present invention, are commonly used in the automotive industry. Often, these latches are employed to secure the contents of a compartment in a cargo area. The latch of the present invention can be used in compartments and bins in various locations such as glove compartments and storage areas in vehicles. For example, load floor latches find use for securing a floor panel, such as the panel which regulates access to vehicle items, such as spare tires, tools, jacks, batteries, and the like. In many cases, the floor panel is provided on the floor of a passenger vehicle or cargo compartment. The latch therefore must be durable, and it is desirable that the latch be able to withstand substantial force loads, such as those of the type generally encountered by bumps, rough terrain, and especially vehicular accidents, such as crashes, or rollover situations. It is important that compartment contents remain secured in the event of a vehicle crash or rollover. This is especially more important where the cargo compartment is located in the same general area as the vehicle operator, or other passengers. For example, in station wagon type vehicles, the cargo space for passengers and items of cargo is the same. Thus, in this type of vehicle, there is great danger to be encountered should a rollover of the vehicle occur and the latch becomes unsecured. If this were to happen, the compartment contents would spill out into the passenger compartment, thereby placing the vehicle operator in danger. A need exists for a load floor latch which has improved abilities to withstand a rollover, and facilitate latching of a panel, even under high stress conditions. It is also important that the latch, in addition to being durable, be easy to construct and install.

SUMMARY OF THE INVENTION

The present invention is directed to a latch having a housing which holds a handle, a pawl on a pin connected to the housing and a pawl spring which biases the pawl into engagement with a keeper. The latch handle is biased with a handle torsion spring.

The handle rotates the pawl from engagement with a keeper member by engaging the pawl. As the handle is lifted it pivots relative to the housing to engage the pawl and engage the pawl which in turn rotates away from the keeper member. The pawl is retracted against the bias of the pawl spring. When the handle is lifted from the closed position the pawl rotates.

When the latch handle is released, the pawl rotates back to a closed position and the handle rotates back to the closed position. If the handle does not rotate back to the fully closed position, then the handle will close due to the forces acting on the handle by the handle torsion spring. The pawl can also be rotated independently of the handle without the handle moving such as when a panel to which the latch is mounted is slammed shut thereby allowing the pawl of the latch to rotate and engage a keeper and be in a closed position.

The housing preferably provides a gripping area or recess for facilitating grasping of the handle by a user. The housing can further provide a barrier to the compartment covered by the floor panel so that no objects inadvertently fall into the compartment through the latch.

In a second embodiment of the latch the latch is provided with at least one positional stop which engages the handle and prevents further movement of the handle any further past the point where the handle is pivoted to the fully open or unlatched position. The positional stops prevent undesired flexing of the housing when excessive force is applied to the handle and also prevent the handle from being pulled out of the housing.

In this embodiment of the latch the housing of the latch is provided with a pawl stop which contacts a pawl projection of the pawl to prevent further pivoting of the pawl any further past the point where the pawl engages the keeper.

Also, in this embodiment of the latch further comprises a plurality of snap legs on an exterior surface of the housing, the snap legs being substantially flexible and providing a snap fit connection which connects the first closure member to the latch. Each of the snap legs can have an upper surface facing in the direction of the handle, the upper surface for engaging said first closure member and the upper surface being angled toward the handle in the direction of the housing. The latch can then accommodate different first closure members of varying thicknesses while still maintaining the latch in position in the first closure member in which the latch is mounted.

The second embodiment of the latch as described below also has the handle and pawl configured such that the handle can pivot through an arc prior to the handle engaging and retracting the pawl to an unlatched position. Preferably the handle pivots a total of 26 to 29 degrees prior to the handle or an actuator of the handle engaging the pawl and retracting the pawl from the engaged or latched position.

Another object of the invention is to provide a spring biased latch which allows a first panel to be fastened to a second panel due to forces acting on the second panel by a pawl of the latch. This is accomplished by a pawl which interacts with a keeper on the second panel.

Another object of the present invention is to provide a latch which can be used in connection with panels of vehicles to regulate access to and from an area or compartment, such as, for example, a floor panel and a floor storage compartment.

It is another object of the present invention to provide a latch which can be used in an installation where the latch is mounted on a closure panel to regulate entry into an enclosure covered by the closure panel and provide a barrier to prevent a user's hand or fingers, or objects, from inadvertently entering the compartment.

Another object of the present invention is to provide a novel latch which can secure one or more panels or members together, for release upon actuating a handle of the latch.

Another object of the present invention is to provide a novel latch having a pawl which can remain engaged to a keeper mounted on a vehicle under severe conditions such during rollovers and crashes.

These and other objects of the present invention will be more readily apparent when taken into consideration with the following description and the attached drawings.

BRIEF DESCRIPTION OF THE DRAWINGS

FIG. 1 is a top view of an embodiment of a latch in accordance with the present invention showing the handle and housing.

FIG. 2 is a bottom view of the latch of FIG. 1.

FIG. 3 is a side view of the latch of FIG. 1 showing the pawl in the closed position.

FIG. 4 is a front view of the latch of FIG. 1 showing the pawl.

FIG. 5 is a perspective view of the latch of FIG. 1 showing the pawl in the closed position.

FIGS. 27 and 28 are perspective views of the latch of FIG. 1 showing the handle being inserted into the housing.

FIG. 29 is a perspective view of the latch of FIG. 1 showing the handle inserted into the housing.

Figure 36:
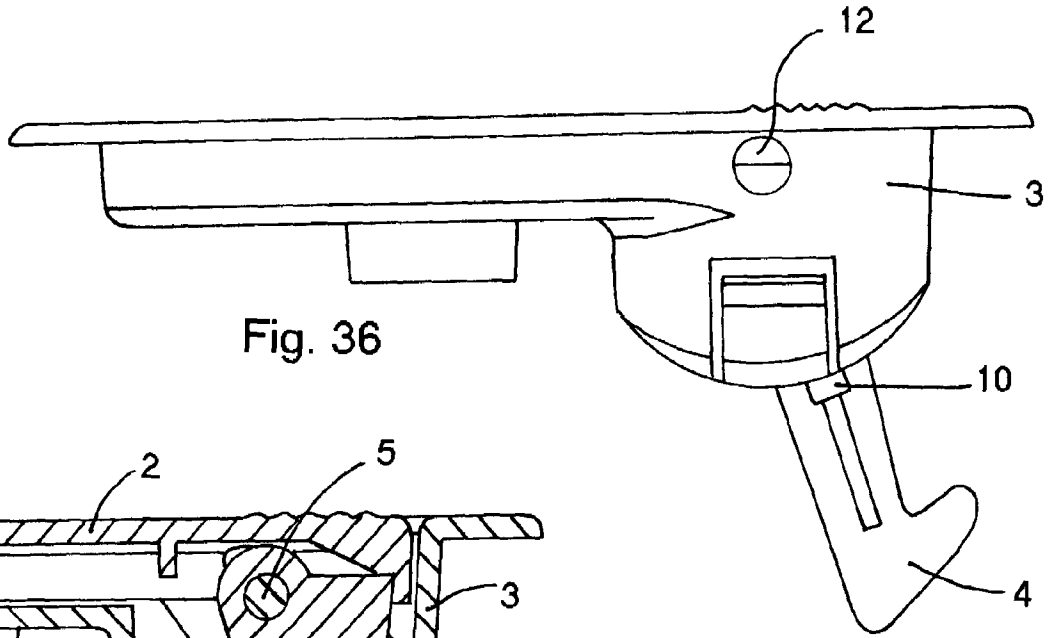
FIG. 36 is a side view of the latch of FIG. 1 showing the latch in the closed position.

FIG. **36*b* is a sectional view of the latch of FIG. 36** showing the latch in the closed position.

Figure 37:
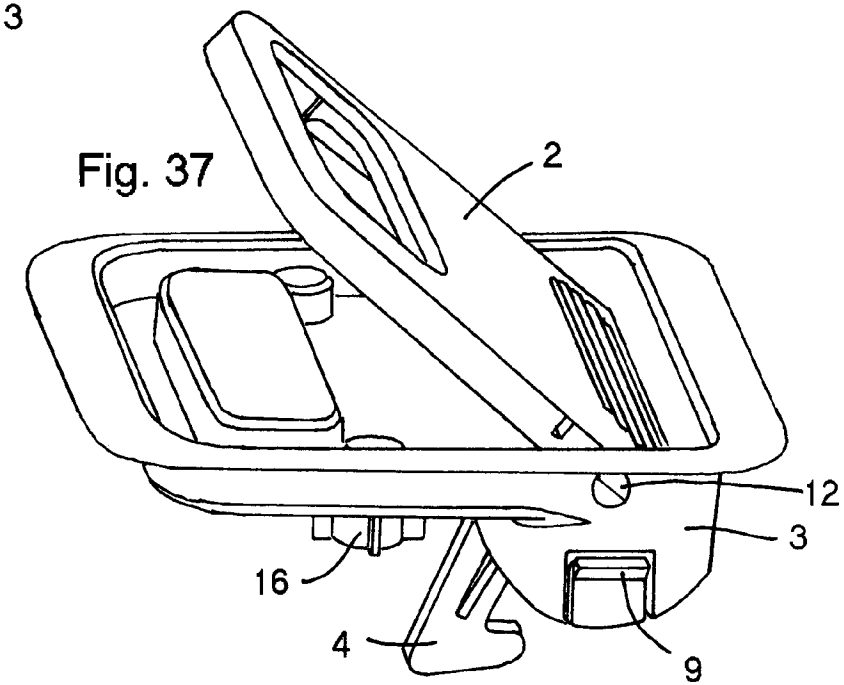
Figure 35:
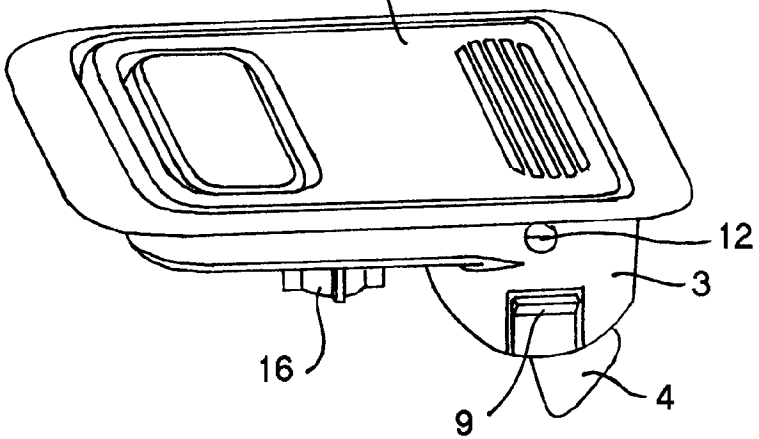
FIG. 35 is a perspective view of the latch of FIG. 1 showing the latch in the closed position.

FIG. 37 is a top perspective view of the latch of FIG. 1 showing the latch in the open position.

Figures 38, 38B:
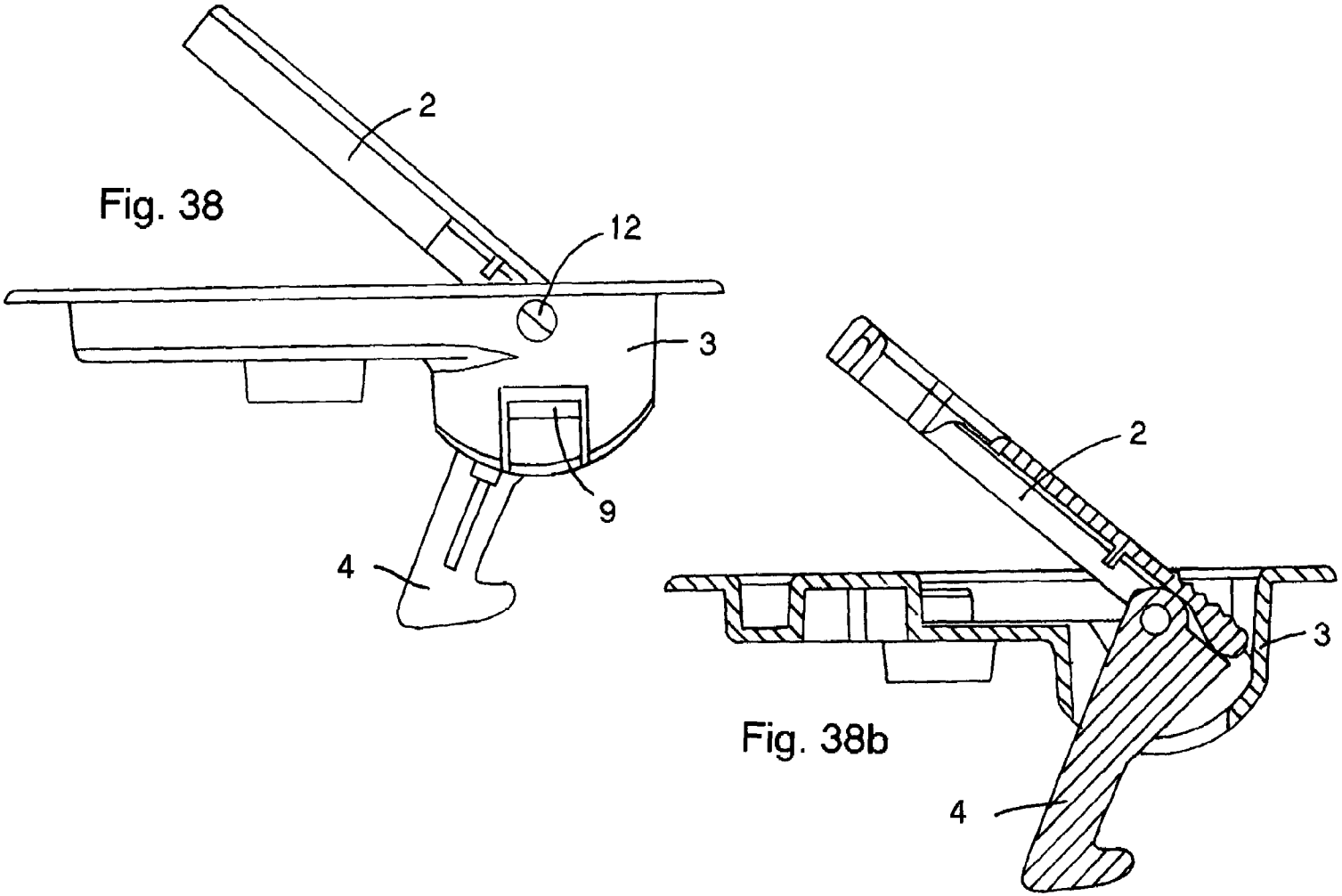

FIG. 38 is a side view of the latch of FIG. 1 showing the latch in the open position.

FIG. **38*b* is a sectional view of the latch of FIG. 38** showing the latch in the open position.

Figure 39:
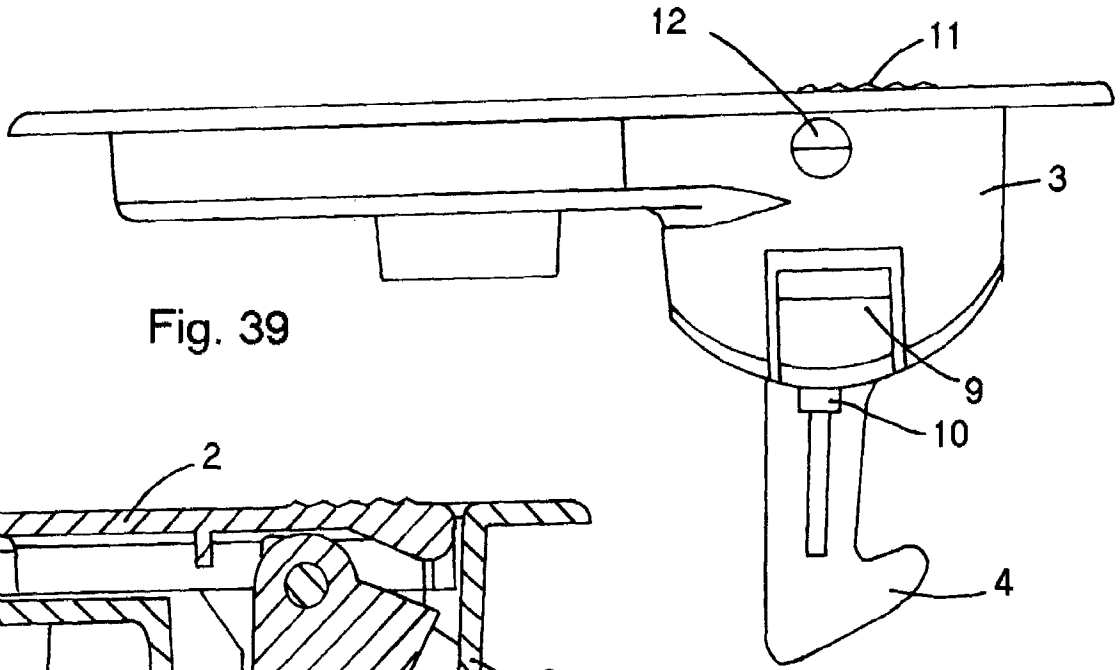
Figure 39B:
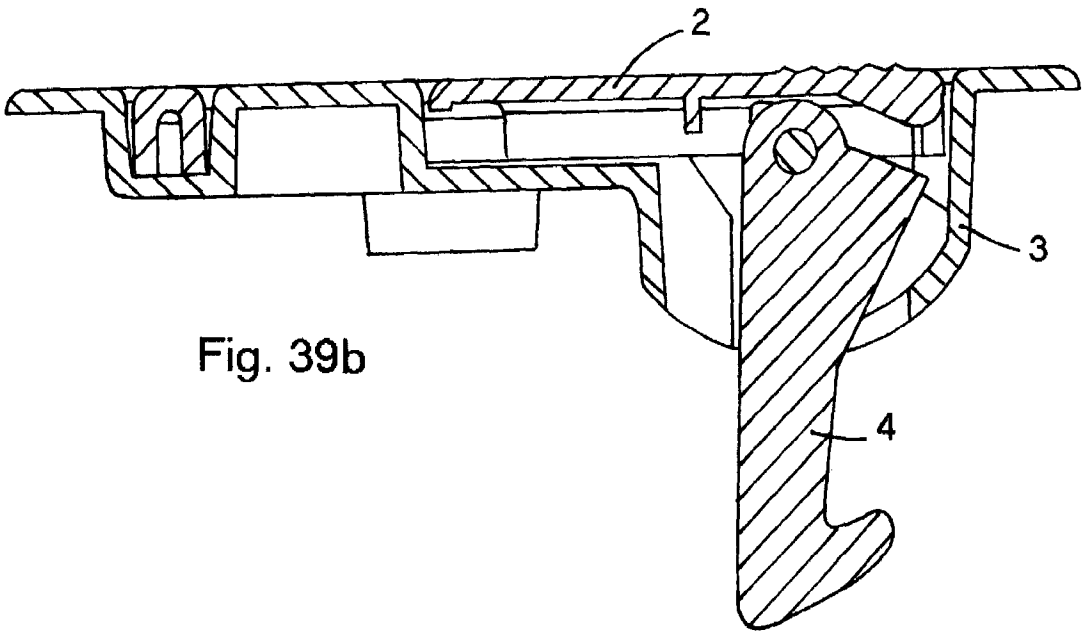

FIG. 39 is a side view of the latch of FIG. 1 showing the handle released and in a closed position due to the action of a spring on the handle while the pawl is between a latched and an unlatched position.

FIG. **39*b* is a sectional view of the latch of FIG. 39**.

FIG. **39*c* is a sectional view of the latch of FIG. 1** in a latched position.

Figure 40:
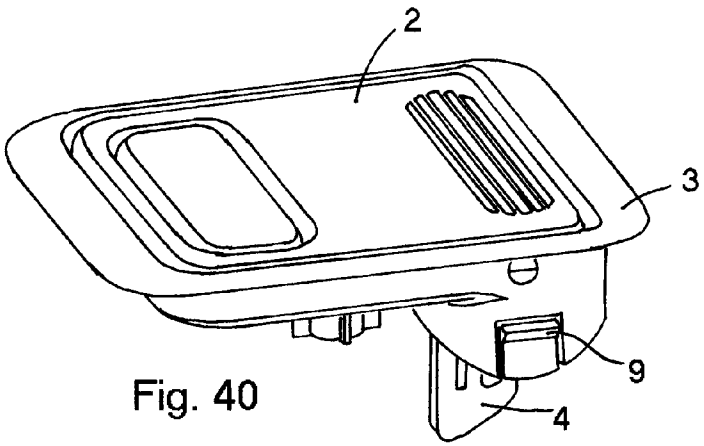

FIG. 40 is a perspective view of the latch of FIG. 39.

Figure 41:
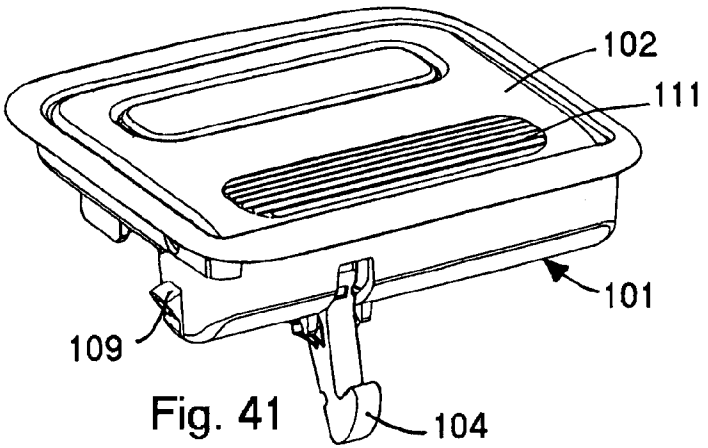

FIG. 41 is a top perspective view of a second embodiment of the present invention showing the handle and housing.

Figure 42:
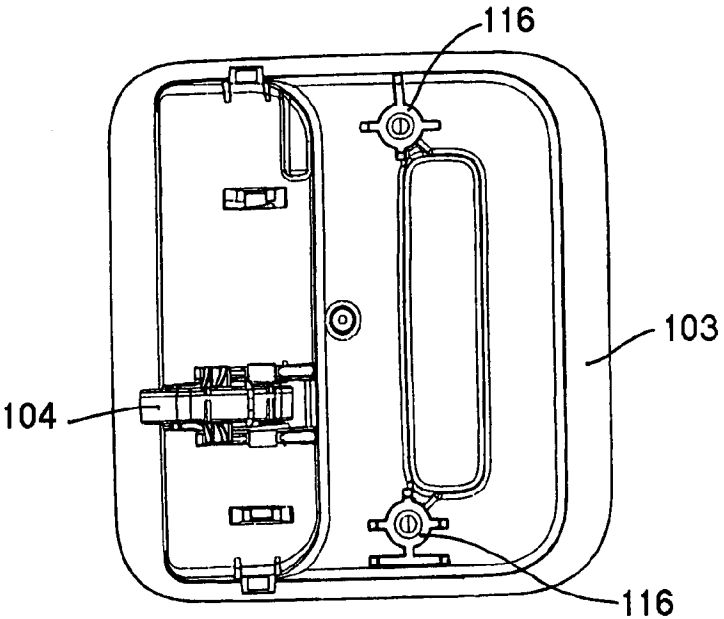

FIG. 42 is a bottom view of the latch of FIG. 41.

Figure 43:
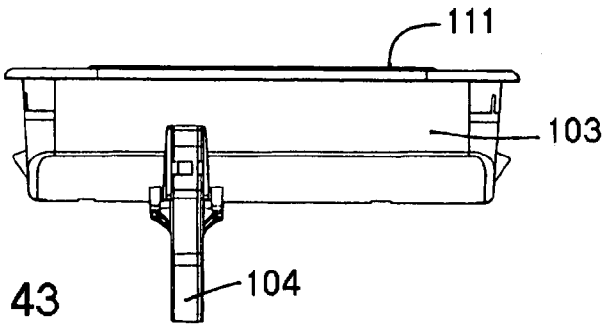

FIG. 43 is a front view of the latch of FIG. 41.

Figure 44:
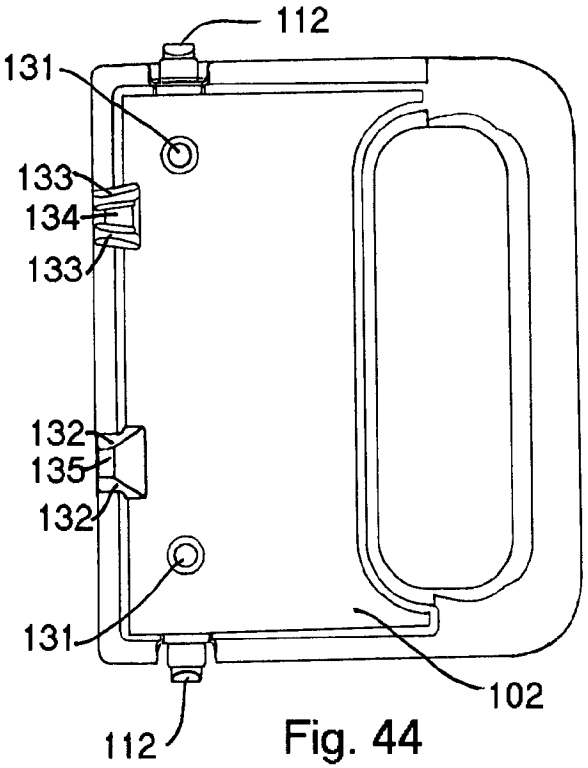

FIG. 44 is a bottom view of the handle of the latch of FIG. 41.

Figure 45:
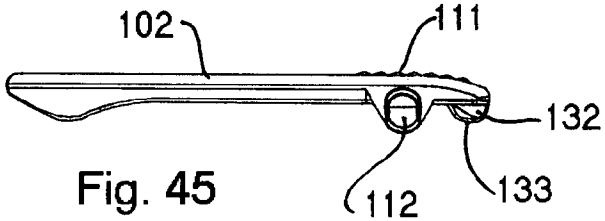

FIG. 45 is a side view of the handle of the latch of FIG. 41.

Figure 46:
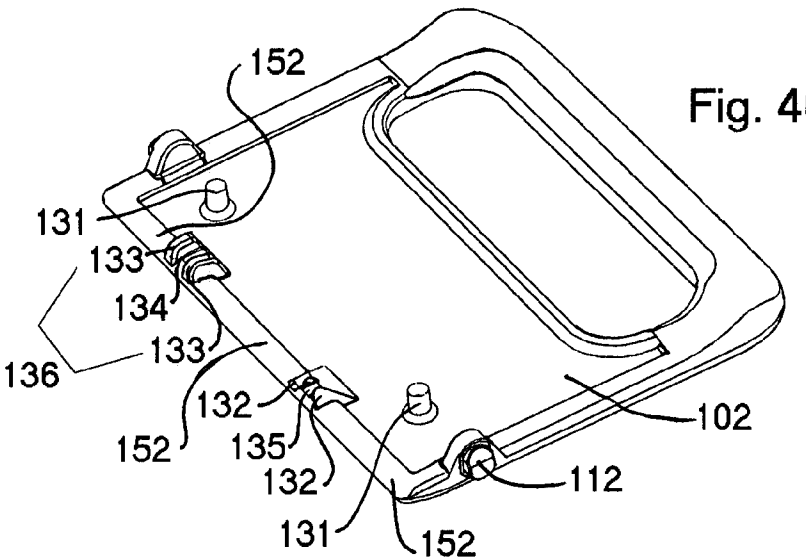

FIG. 46 is a perspective view of the top of the handle of the latch of FIG. 41.

Figure 47:
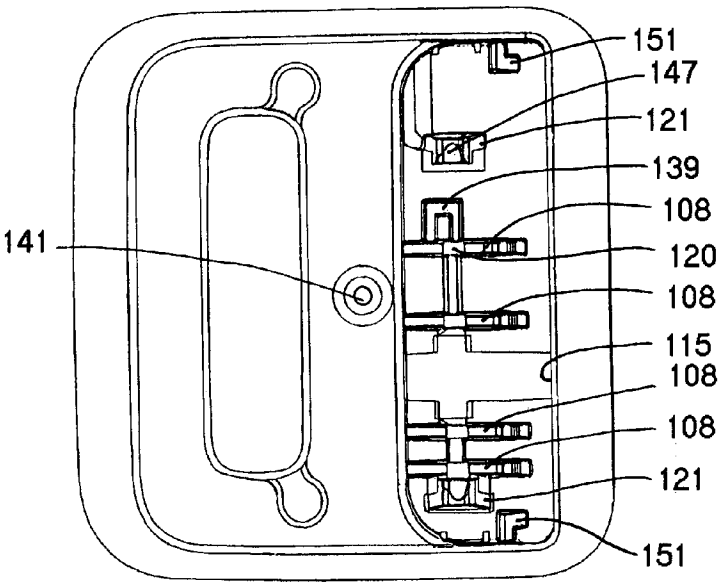

FIG. 47 is a top view of the housing of the latch of FIG. 41.

Figure 48:
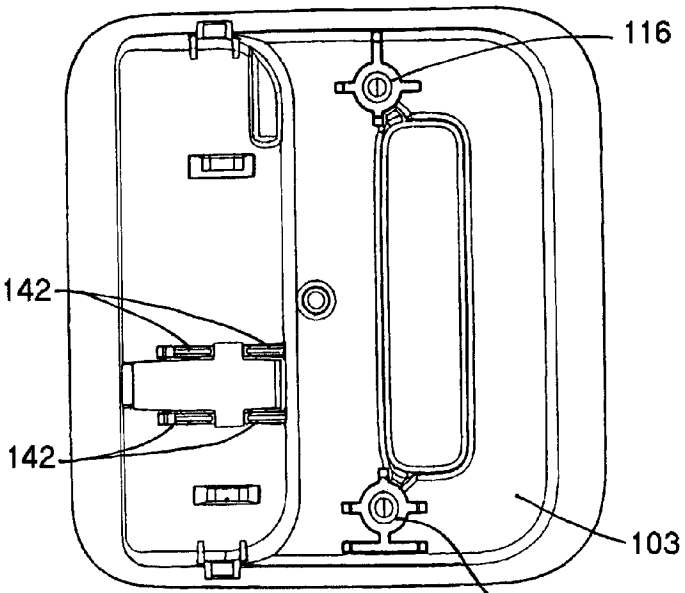

FIG. 48 is a bottom view of the housing of the latch of FIG. 41.

Figure 49:
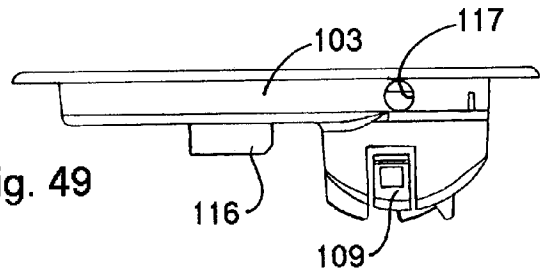

FIG. 49 is a side view of the housing of the latch of FIG. 41.

Figure 50:
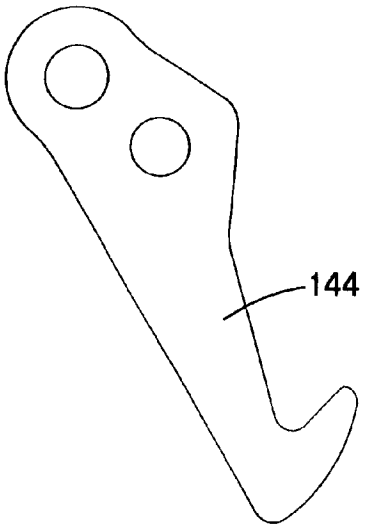

FIG. 50 is a side view of the pawl core of the latch of FIG. 41 prior to the pawl core being overmolded.

Figure 51:
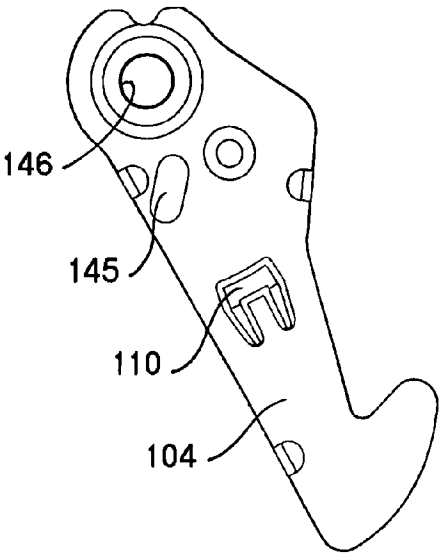

FIG. 51 is a side view of the pawl core of the latch of FIG. 41 after the pawl core has been overmolded.

Figure 52:
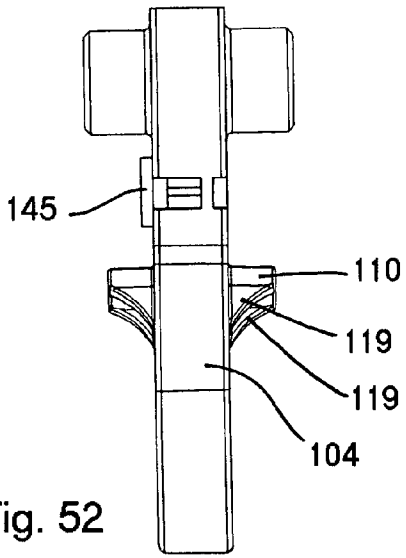

FIG. 52 is a front view of the pawl core of the latch of FIG. 41 after the pawl core has been overmolded.

Figure 53:
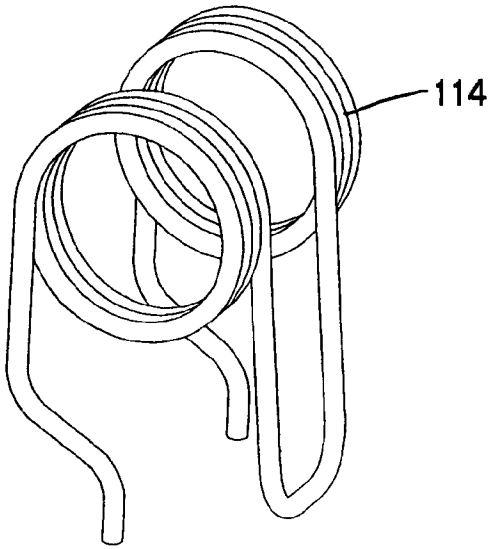

FIG. 53 is a perspective view of the pawl double torsion spring of the latch of FIG. 41.

Figure 54:
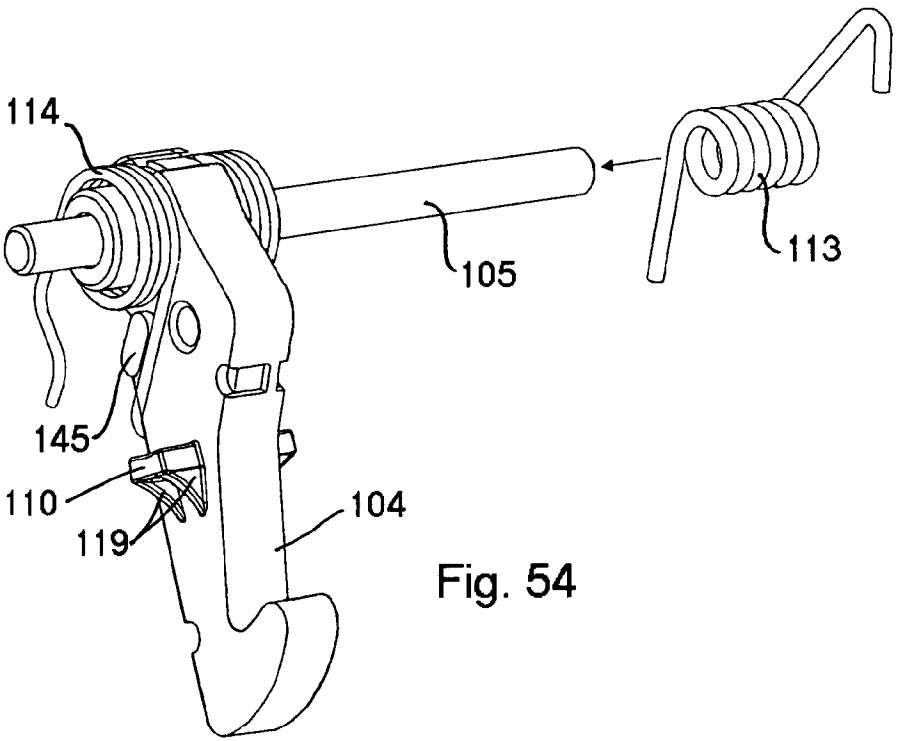

FIG. 54 is a perspective view of the pawl double torsion spring of the latch of FIG. 41 shown mounted on the pawl which in turn is being mounted on the pin.

Figures 55, 56, 57:
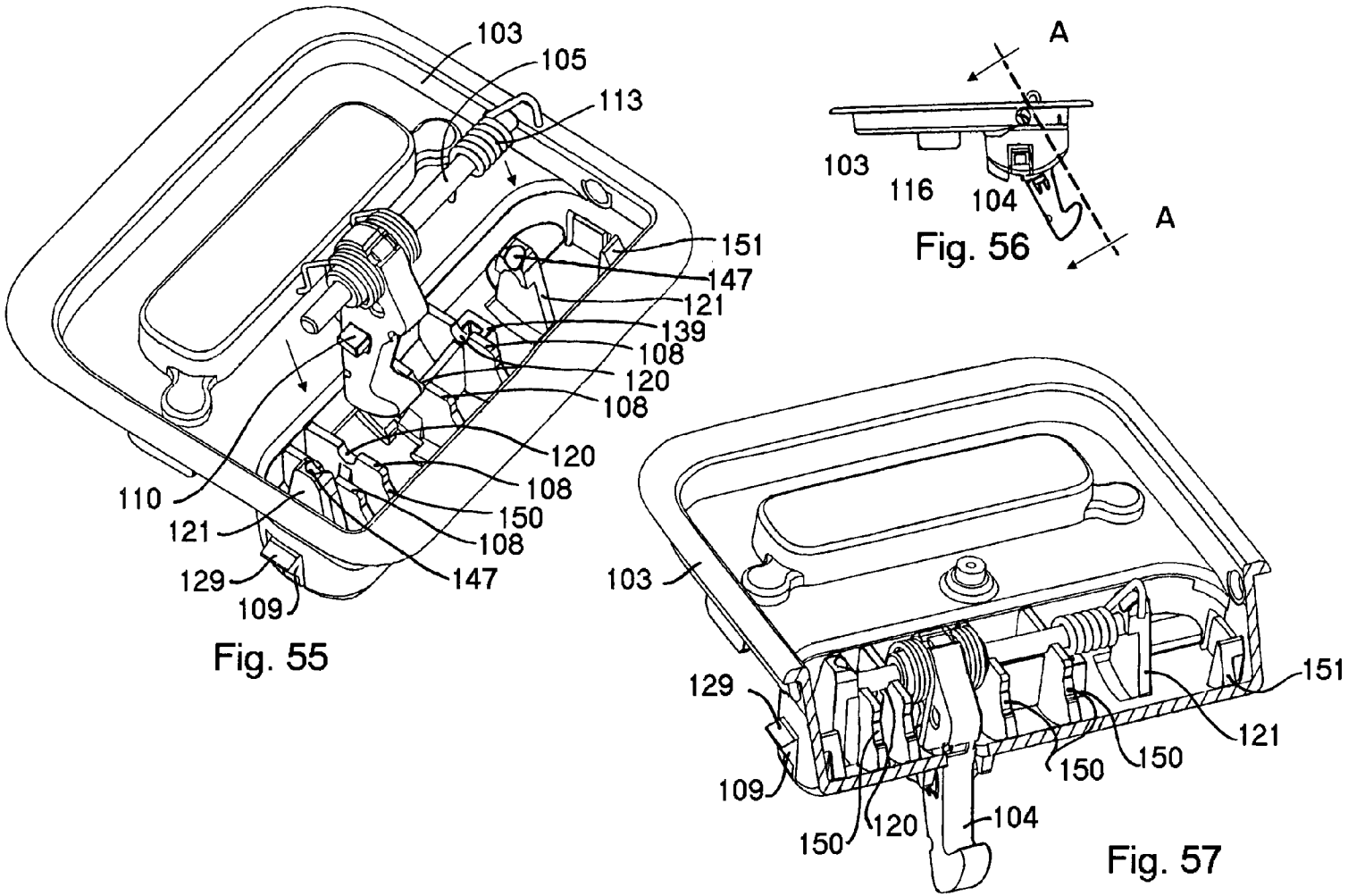

FIG. 55 is a perspective view of the housing, pawl, pawl double torsion spring, and handle spring of the latch of FIG. 41 shown being mounted on the housing with the pin inserted into the pawl.

FIG. 56 is a side view of the latch of FIG. 41.

FIG. 57 is a perspective view of the latch of FIG. 41 taken along line A—A of FIG. 56.

Figure 58:
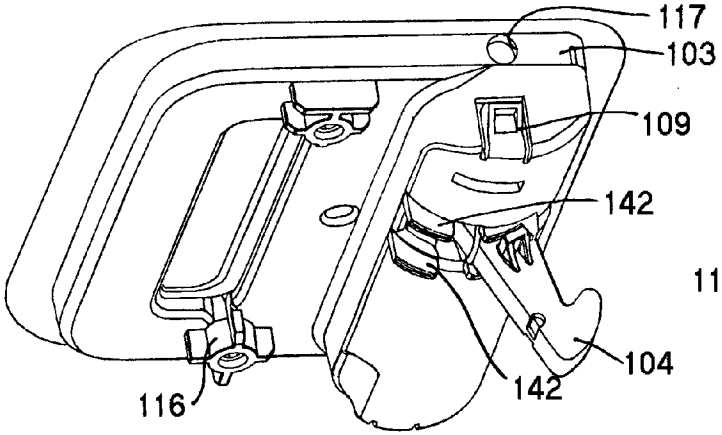

FIG. 58 is a perspective view of the bottom of the latch of FIG. 41 showing the pawl in the latched position.

Figure 59:
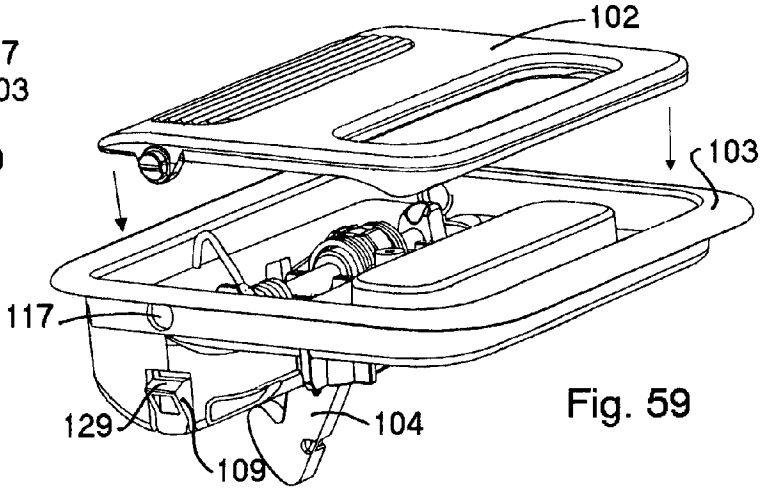

FIG. 59 is a perspective view of the latch of FIG. 41 showing the handle being inserted into the housing.

Figure 60:
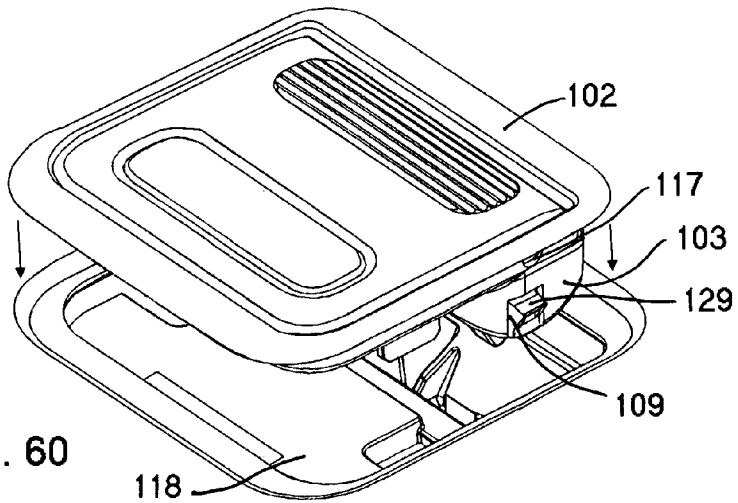

FIG. 60 is a perspective view of the latch of FIG. 41 showing the latch being inserted into the first closure panel.

Figures 61, 62:
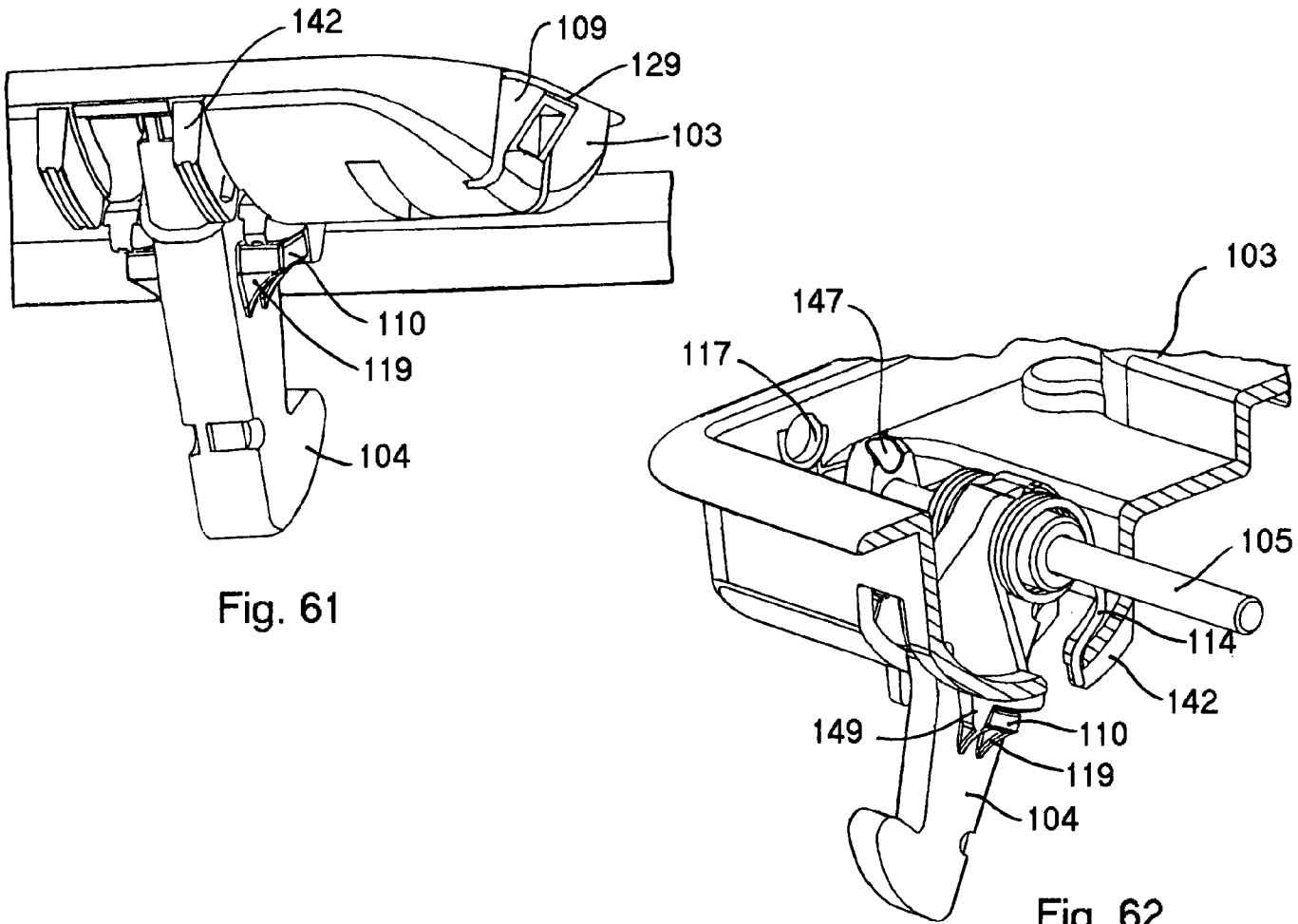

FIG. 61 is a perspective view of the bottom of the latch of FIG. 41 showing the latch in the latched position.

FIG. 62 is a perspective view of a portion of the latch of FIG. 41 showing the latch in the latched position.

Figure 63:
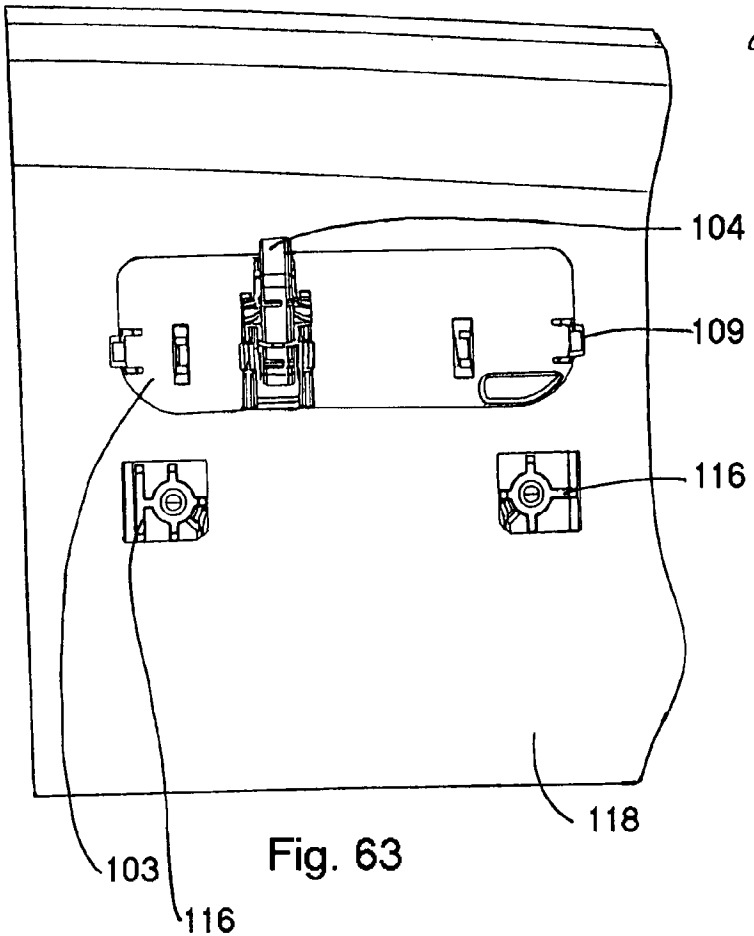

FIG. 63 is a bottom view of the latch of FIG. 41 after being inserted into a first closure member.

Figure 64:
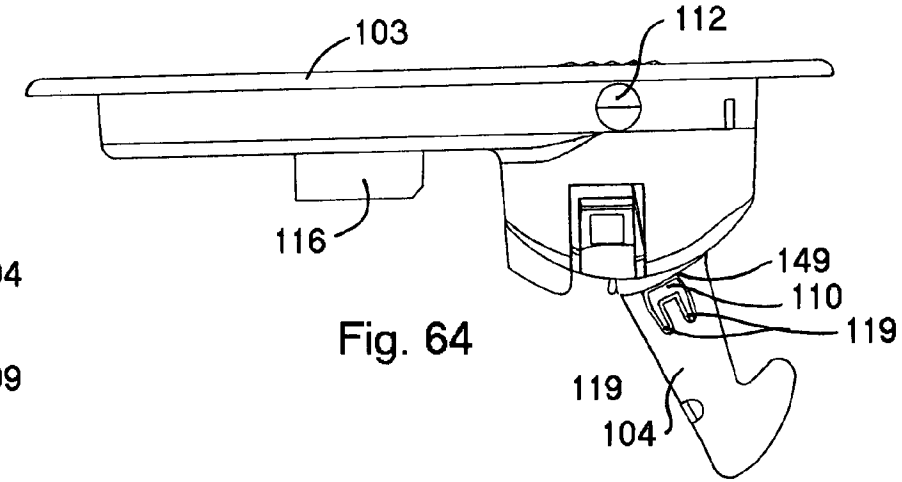

FIG. 64 is a side view of the latch of FIG. 41 in the latched position.

Figure 65:
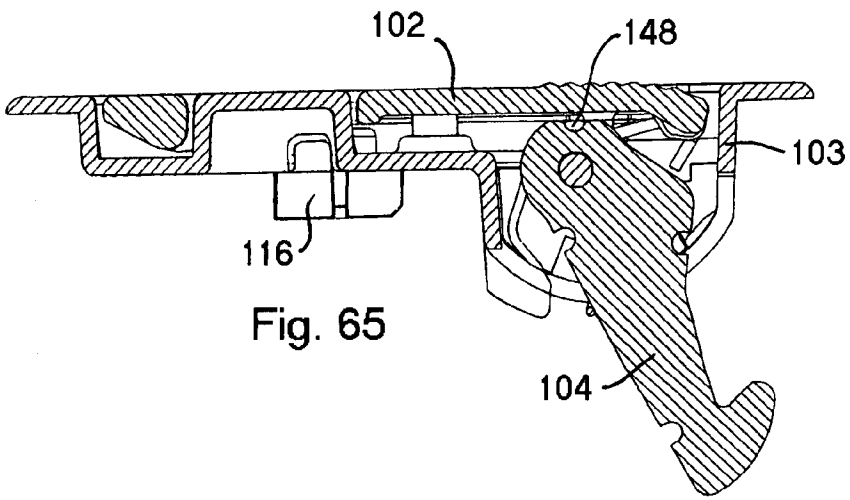

FIG. 65 is a sectional view of the latch of FIG. 64 in the latched position.

Figure 66:
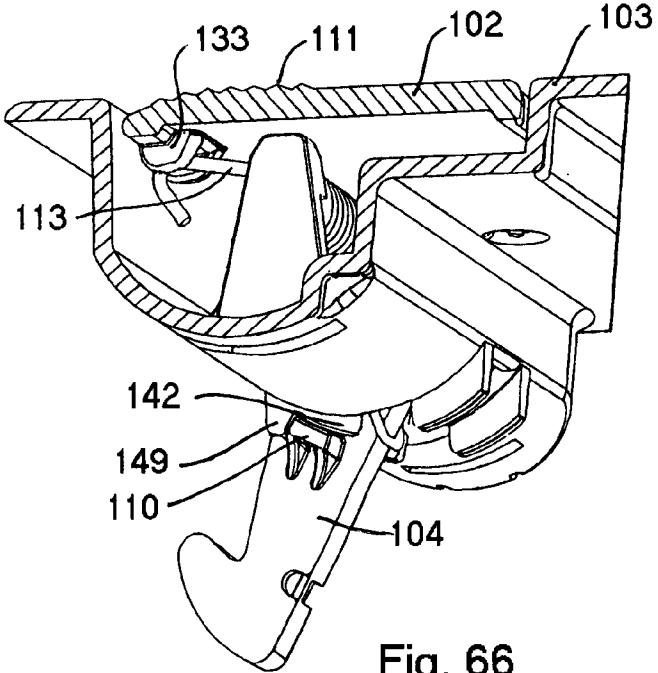

FIG. 66 is a perspective view of the bottom of the latch of FIG. 41 in the latched position.

Figure 67:
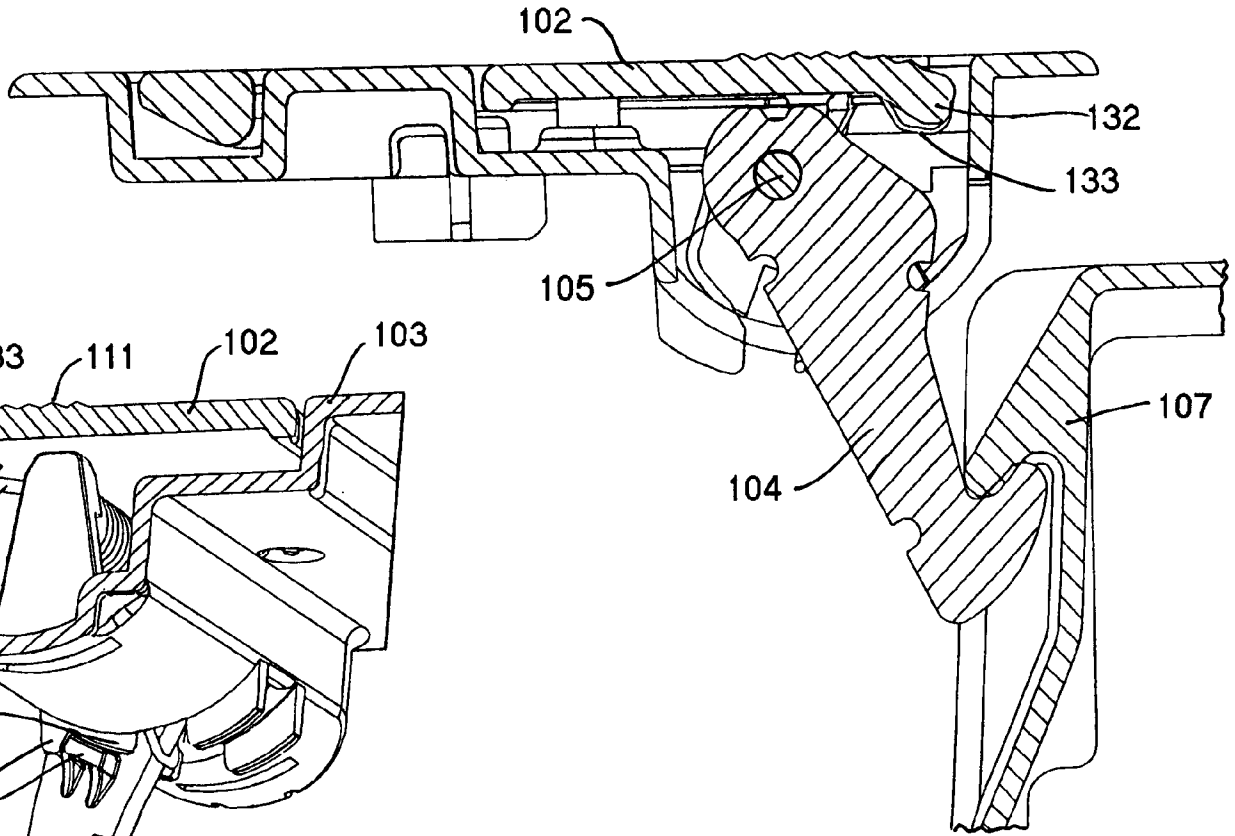

FIG. 67 is a sectional view of the latch of FIG. 41 showing the latch engaged with a keeper.

Figure 68:
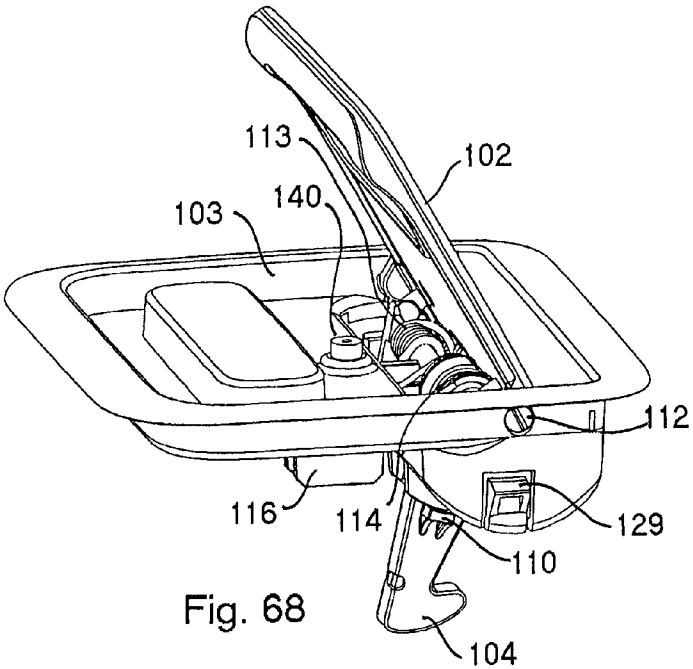

FIG. 68 is a perspective view of the latch of FIG. 41 showing the latch in the unlatched position.

Figure 69:
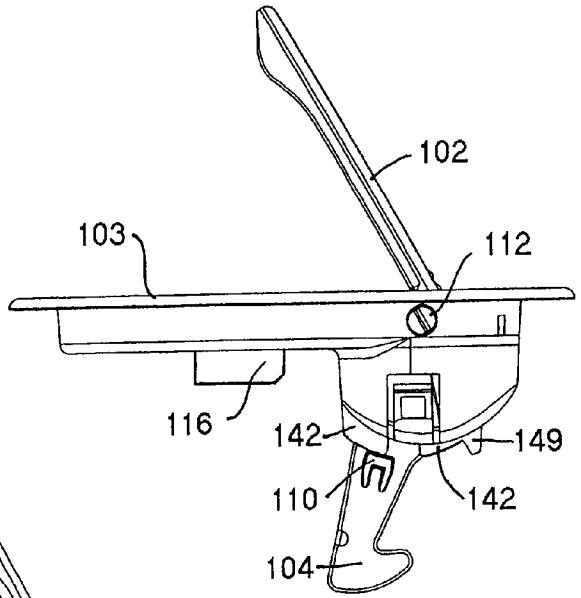

FIG. 69 is a side view of the latch of FIG. 41 in the unlatched position.

Figure 70:
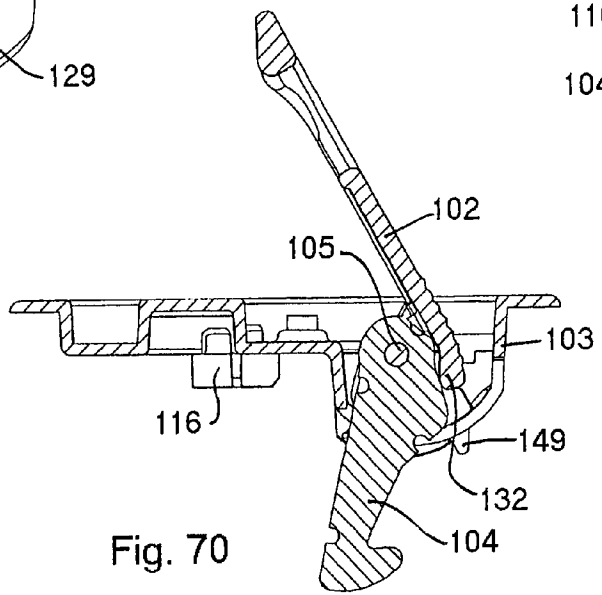

FIG. 70 is a sectional view of the latch of FIG. 69 in the unlatched position.

DETAILED DESCRIPTION OF THE INVENTION

Referring now to the drawings in detail, wherein like reference numerals indicate like elements through the several views, there is shown in FIGS. 1–5, views of a first embodiment of a latch 1 of the present invention shown with a housing 3 and handle 2.

Figure 7:
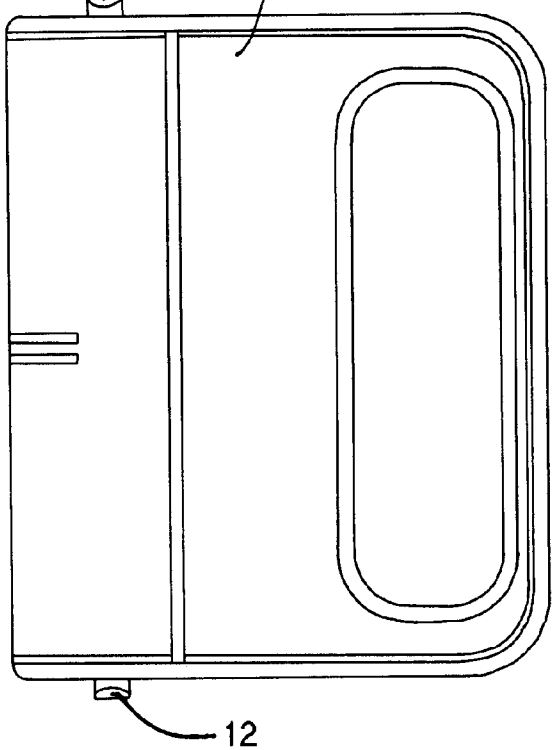
FIG. 7 is a bottom view of the handle of the latch of FIG. 1.
Figure 6:
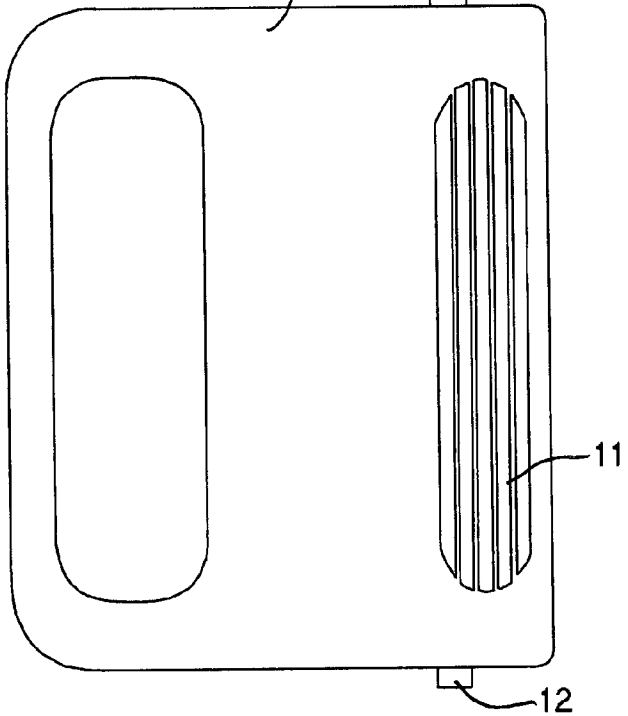
FIG. 6 is a top view of the handle of the latch of FIG. 1.
Figure 8:
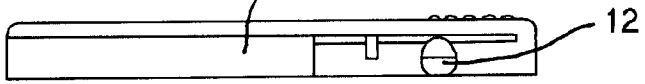
FIG. 8 is a side view of the handle of the latch of FIG. 1.
Figure 10:
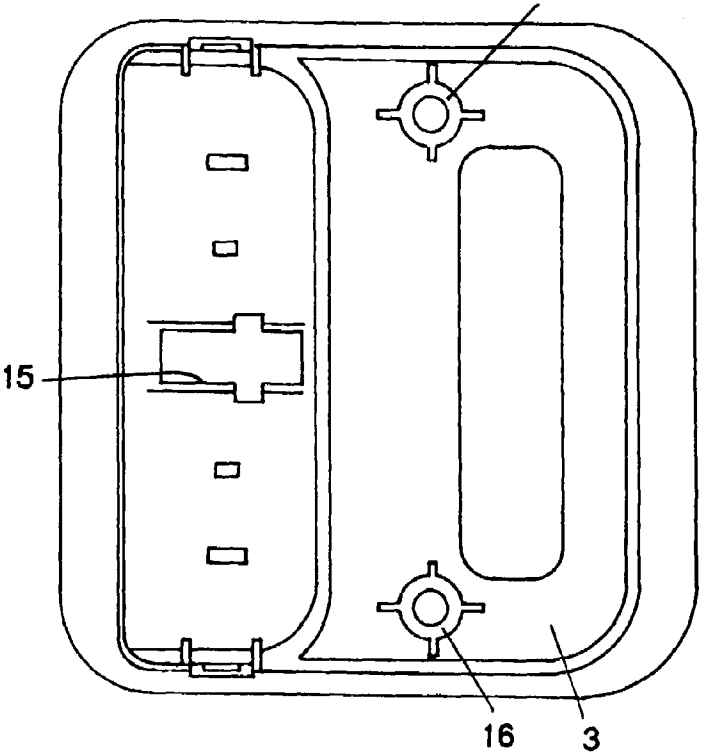
FIG. 10 is a bottom view of the housing of the latch of FIG. 1.
Figure 9:
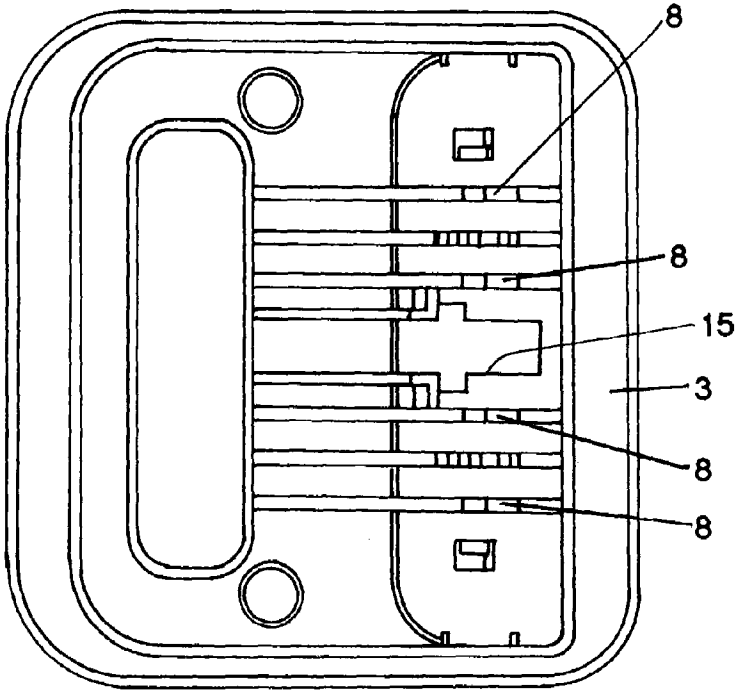
FIG. 9 is a top view of the housing of the latch of FIG. 1.
Figure 11:
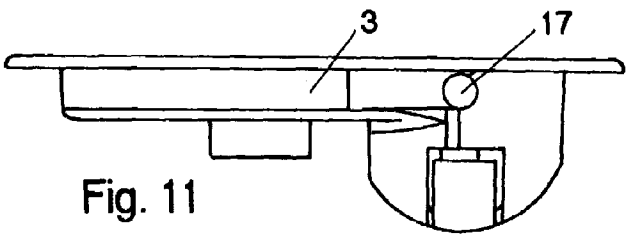
FIG. 11 is a side view of the housing of the latch of FIG. 1.
Figure 15:
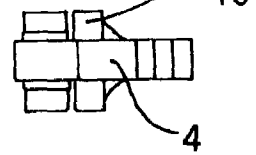
FIG. 15 is a top view of the pawl of the latch of FIG. 1 after the pawl is overmolded.
Figure 16:
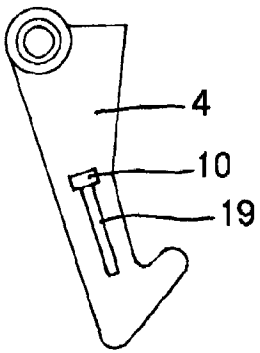
FIG. 16 is a side view of the pawl of the latch of FIG. 1 after the pawl is overmolded.
Figure 17:
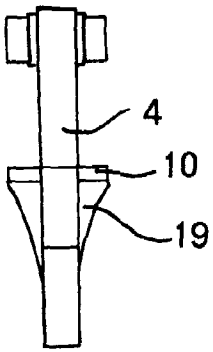
FIG. 17 is a front view of the pawl of the latch of FIG. 1 after the pawl is overmolded.
Figure 19:
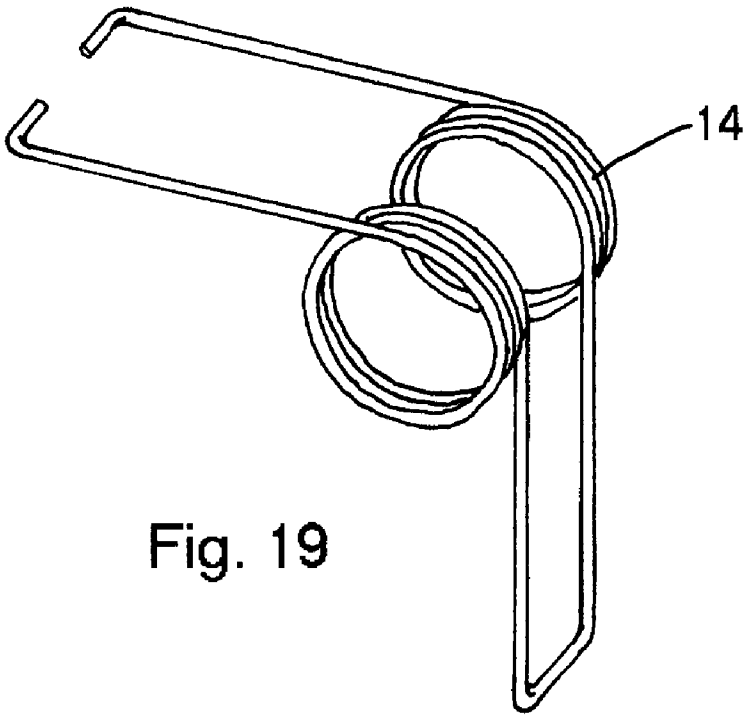
FIG. 19 is a perspective view of the pawl double torsion spring of the latch of FIG. 1.
Figure 18:
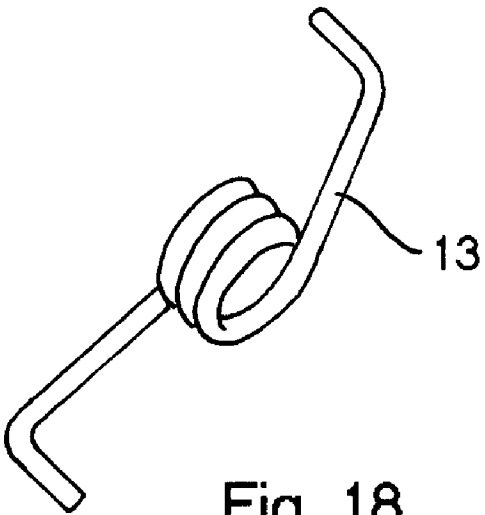
FIG. 18 is a perspective view of the handle torsion spring of the latch of FIG. 1.

The handle 2 as shown in FIGS. 6–8 has a ribbed gripping portion 11 which provides traction for a user who operates the handle 2. The handle 2 has a boss 12 on opposite sides of the handle 2. The housing 3 as shown in FIGS. 9–11 has housing aperture 15 through which pawl 4 as shown in FIGS. 15–17 projects. Each boss 12 of the handle 2 fits through a respective housing hole 17 when the latch 1 is assembled. In the top view of the housing 3 seen in FIG. 9, ribs 8 extend from one side of the housing 3 to an interior portion of the housing 3. Bosses 16 in the housing 3 are preferably threaded for a screw to be inserted and provide a means for attaching the assembled latch 1 to a first closure member through which a screw is inserted.

Figure 12:
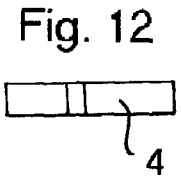
FIG. 12 is a top view of the pawl of the latch of FIG. 1 prior to the pawl being overmolded.
Figure 13:
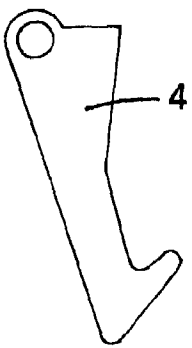
FIG. 13 is a side view of the pawl of the latch of FIG. 1 prior to the pawl being overmolded.
Figure 14:
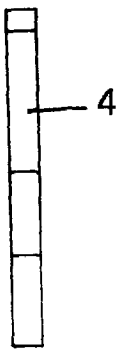
FIG. 14 is a front view of the pawl of the latch of FIG. 1 prior to the pawl being overmolded.
Figure 39C:
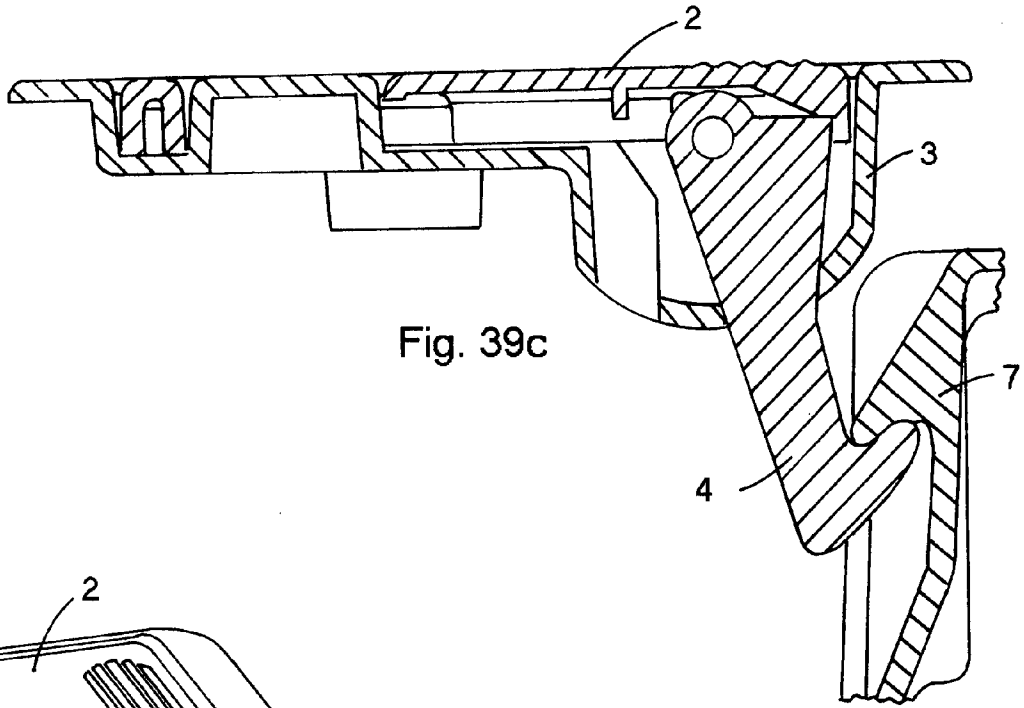

FIGS. 12–14 show pawl 4 prior to being overmolded by plastic. An overmolded pawl 4 having a T-shaped pawl projection 10 mounted therein is shown in FIGS. 15–17. The pawl 4 can be in the shape of a hook as shown in order to more positively engage a keeper 7 such as is shown in FIG. 39*c*. The pawl 4 is preferably steel which is overmolded with plastic.

Figures 20, 21, 22:
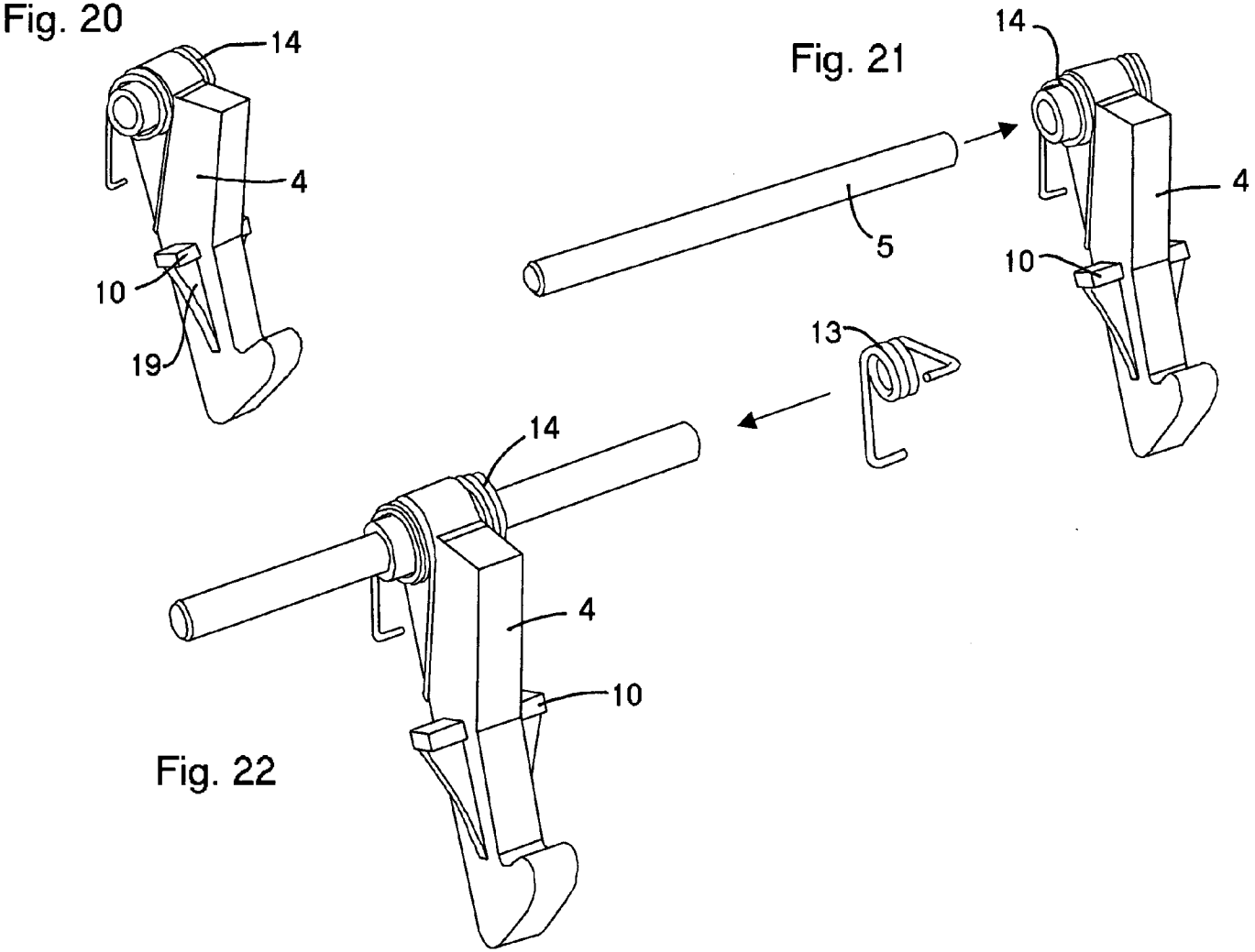
FIG. 20 is a perspective view of the pawl double torsion spring of the latch of FIG. 1 shown mounted on the pawl.
FIG. 21 is a perspective view of the pawl double torsion spring of the latch of FIG. 1 shown mounted on the pawl with the pin being inserted into the pawl.
FIG. 22 is a perspective view of the pawl double torsion spring of the latch of FIG. 1 shown mounted on the pawl with the pin inserted into the pawl.

The latch 1 is assembled as described below. Handle spring 13 fits onto pin 5 and pawl spring 14 fits onto pawl 4 as seen in FIG. 20. When assembled the pawl 4 can move independently of the pin 5. The pawl double torsion spring 14 is assembled over the pawl 4 which has shoulders 19 for the pawl projection 10 molded into the pawl 4 as seen in FIG. 20. The pin 5 is inserted through a hole in the pawl 4 and the pawl 4 and pawl spring 14 are free to rotate about the pin 5 as seen in FIG. 21. The handle torsion spring 13 is placed onto the pin 5 as seen in FIG. 22. In another version of the present invention, the handle spring 13 can be excluded from the latch 1 and the pin 5 with the pawl 4 mounted thereon can be placed directly into housing 3.

Figure 24:
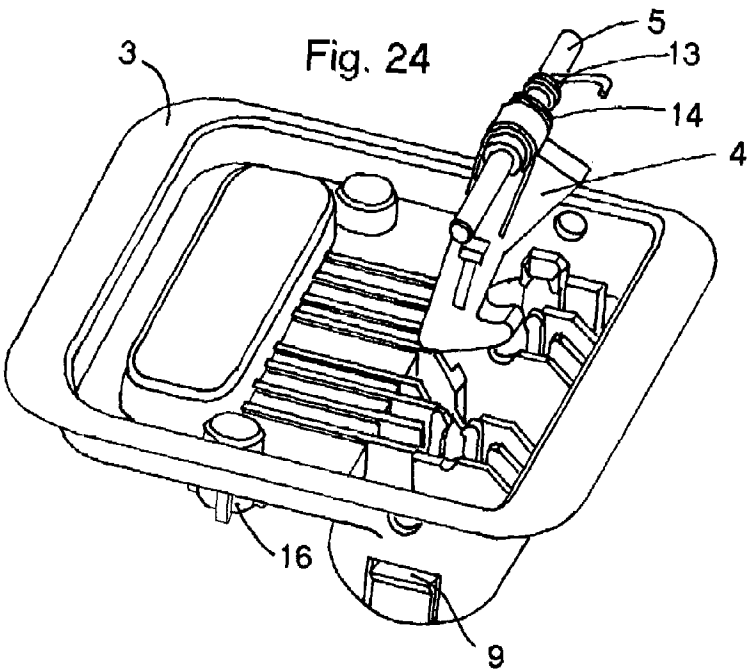
FIG. 24 is a perspective view of the pawl being rotated prior to the insertion of the pawl into the housing of the latch of FIG. 1.
Figure 23:
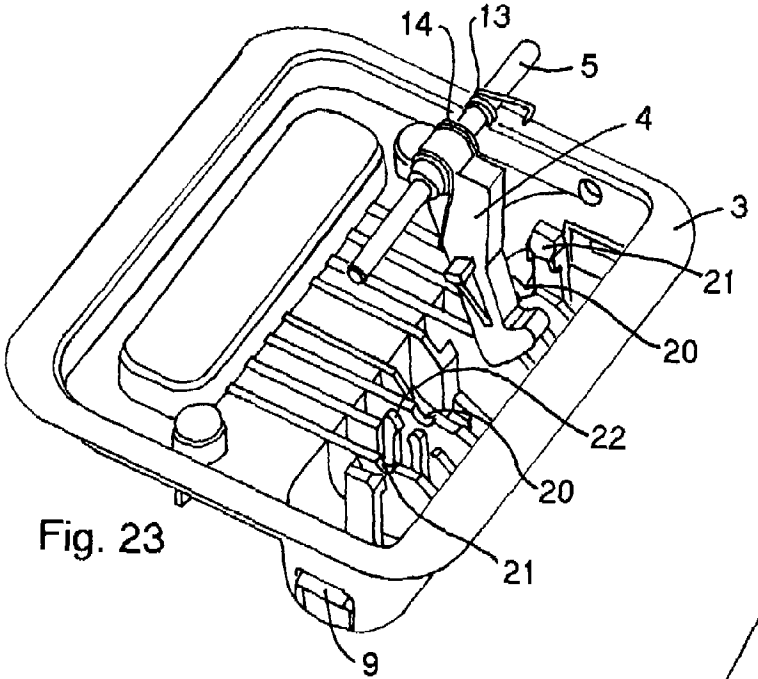
FIG. 23 is a perspective view of the pawl being inserted into the housing of the latch of FIG. 1.

The pin 5, which is inserted in pawl 4, and pawl spring 14 and handle spring 13 which are mounted on pin 5 can be aligned with indentations 20 in ribs 8 of the housing 3 which can be molded into the housing 3 as seen in FIG. 23. The pin 5 with the pawl 4, pawl spring 14 and handle spring 13 can be lowered into the housing 3. The pawl 4 can be rotated about the pin 5 to allow the T-shaped pawl projection 10 to go through the housing aperture 15 in the bottom of the housing 3 as seen in FIG. 24.

Figure 25:
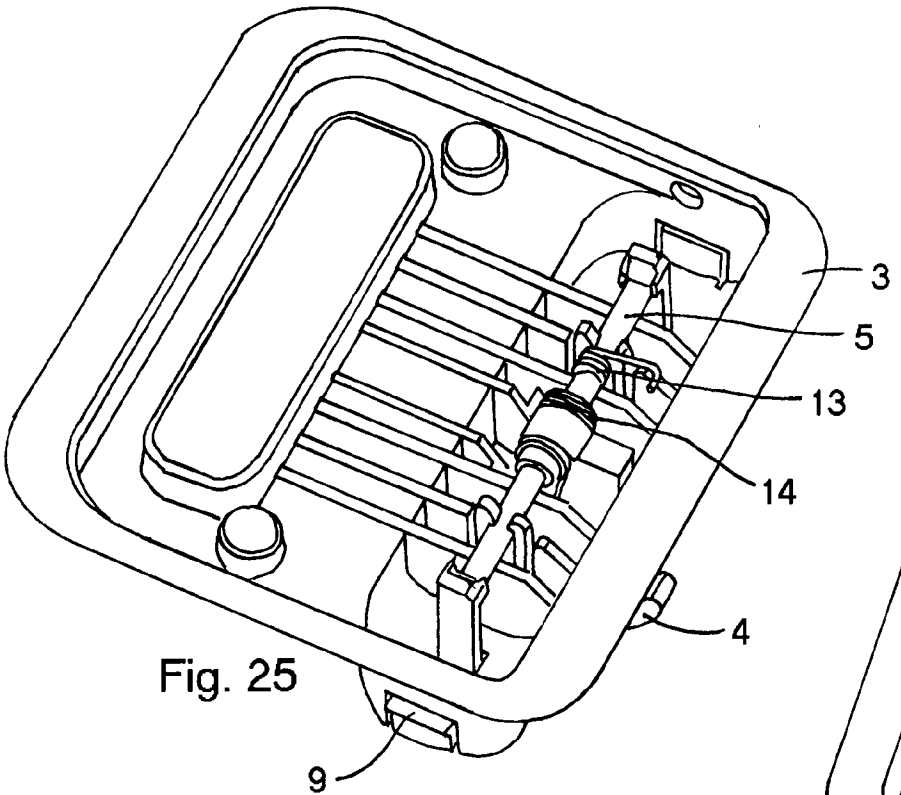
FIG. 25 is a perspective view of the latch of FIG. 1 showing the pawl inserted into the housing.

While lowering the pin 5, pawl 4, pawl spring 14 and handle spring 13 into the housing 3, the pawl double torsion spring legs will be biased such that pre-compression occurs. The pin 5 is snapped into the housing 3 by a snap fit connection against housing pin snap legs 21 which are shown in FIG. 23. Two sets of housing rib snap legs 22 located in the housing ribs 8 retain the pin 5 while two housing pin snap legs 21 (one at either of the ends of the pin) constrain any lateral pin movement as seen in FIGS. 23–25.

Figure 26:
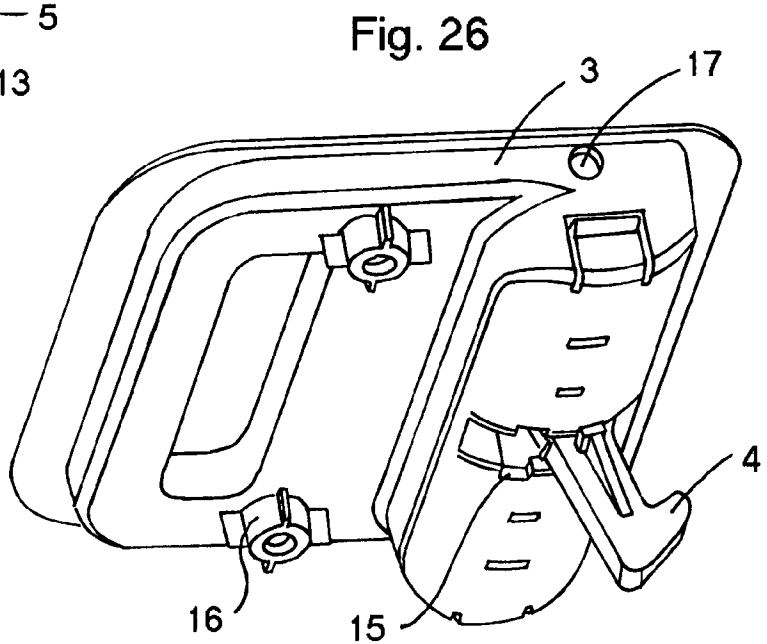
FIG. 26 is a bottom perspective view of the latch of FIG. 1 showing the pawl protruding from the bottom of the housing.

Once the pin 5, pawl 4, pawl spring 14 and handle spring 13 are assembled and snapped into the housing 3 as seen in FIG. 26, the identified components are not intended to be removed.

In FIG. 27, the final component, the handle 2 is assembled by aligning handle 2 with housing 3. An assembler inserts one boss 12 on one side of the handle 2 into corresponding hole 17 in housing 3 as shown in FIG. 28. Finally, the handle 2 is pushed down to snap the second boss 12 into the second housing hole 17 as seen in FIG. 29.

Figure 31:
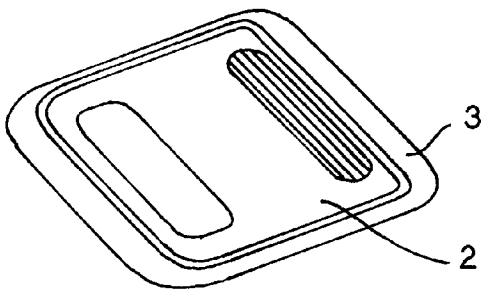
FIG. 31 is a top perspective view of the latch of FIG. 1 after it has been inserted into a first closure member.
Figure 32:
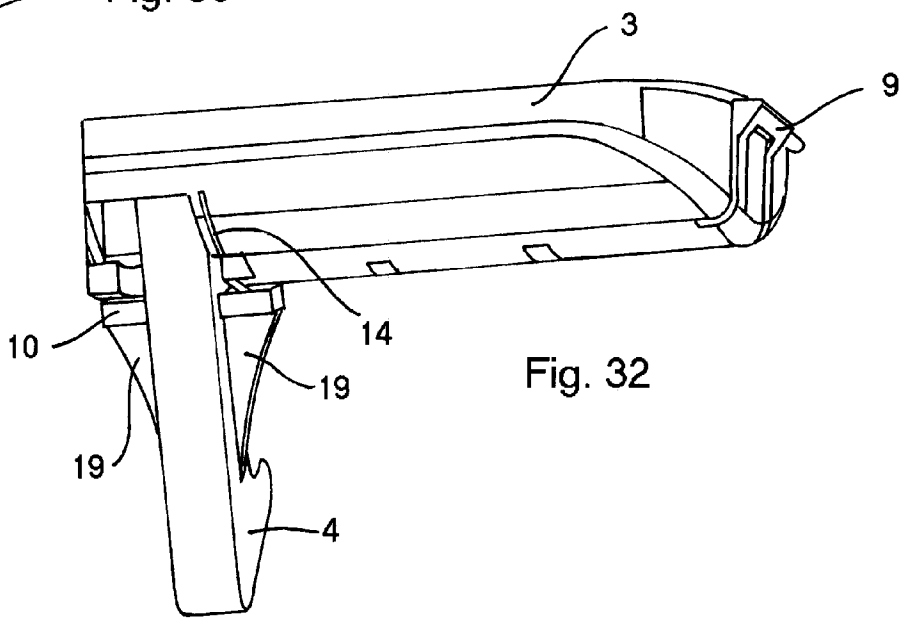
FIG. 32 is a bottom perspective view of a portion of the latch of FIG. 1.
Figure 30:
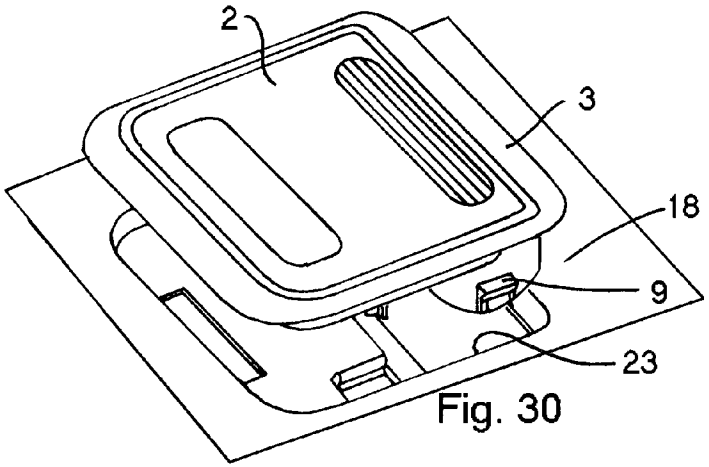
FIG. 30 is a top perspective view of the latch of FIG. 1 being inserted into a first closure member.
Figure 33:
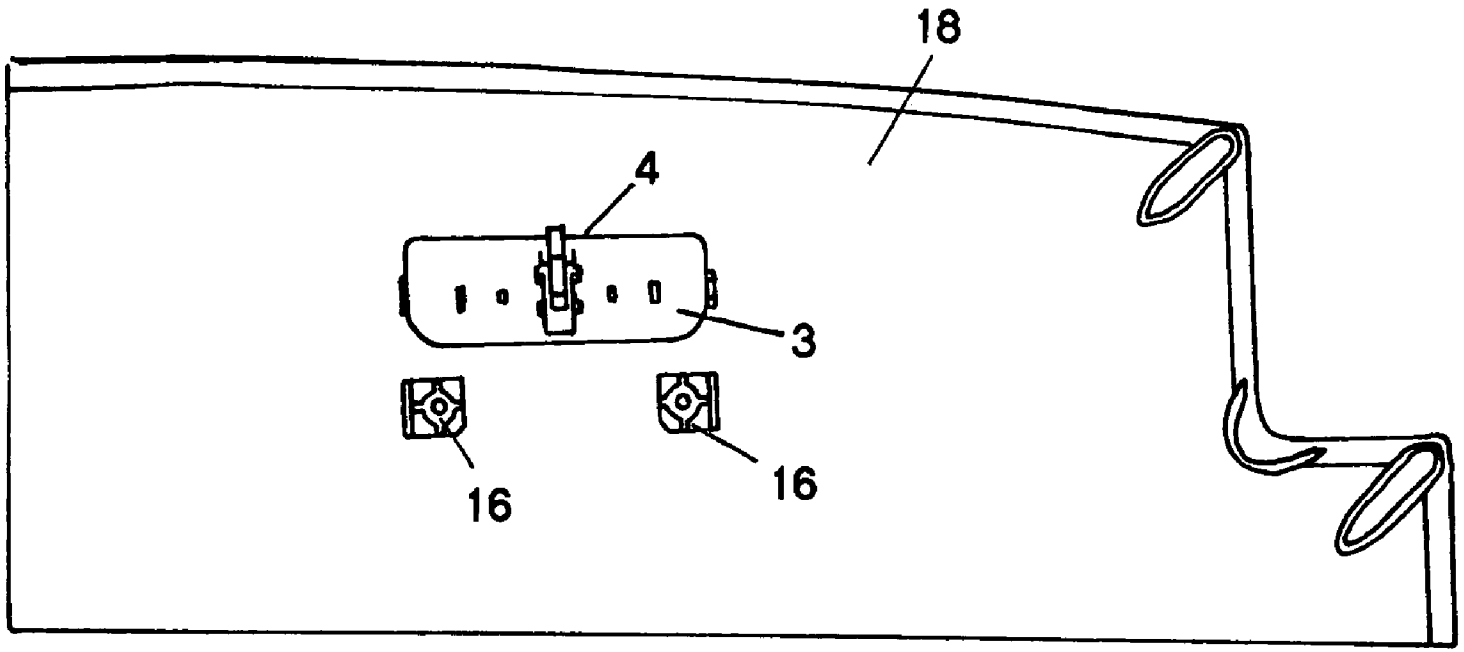
FIG. 33 is a bottom view of the latch of FIG. 1 after the latch has been inserted into the first closure member.
Figure 34:
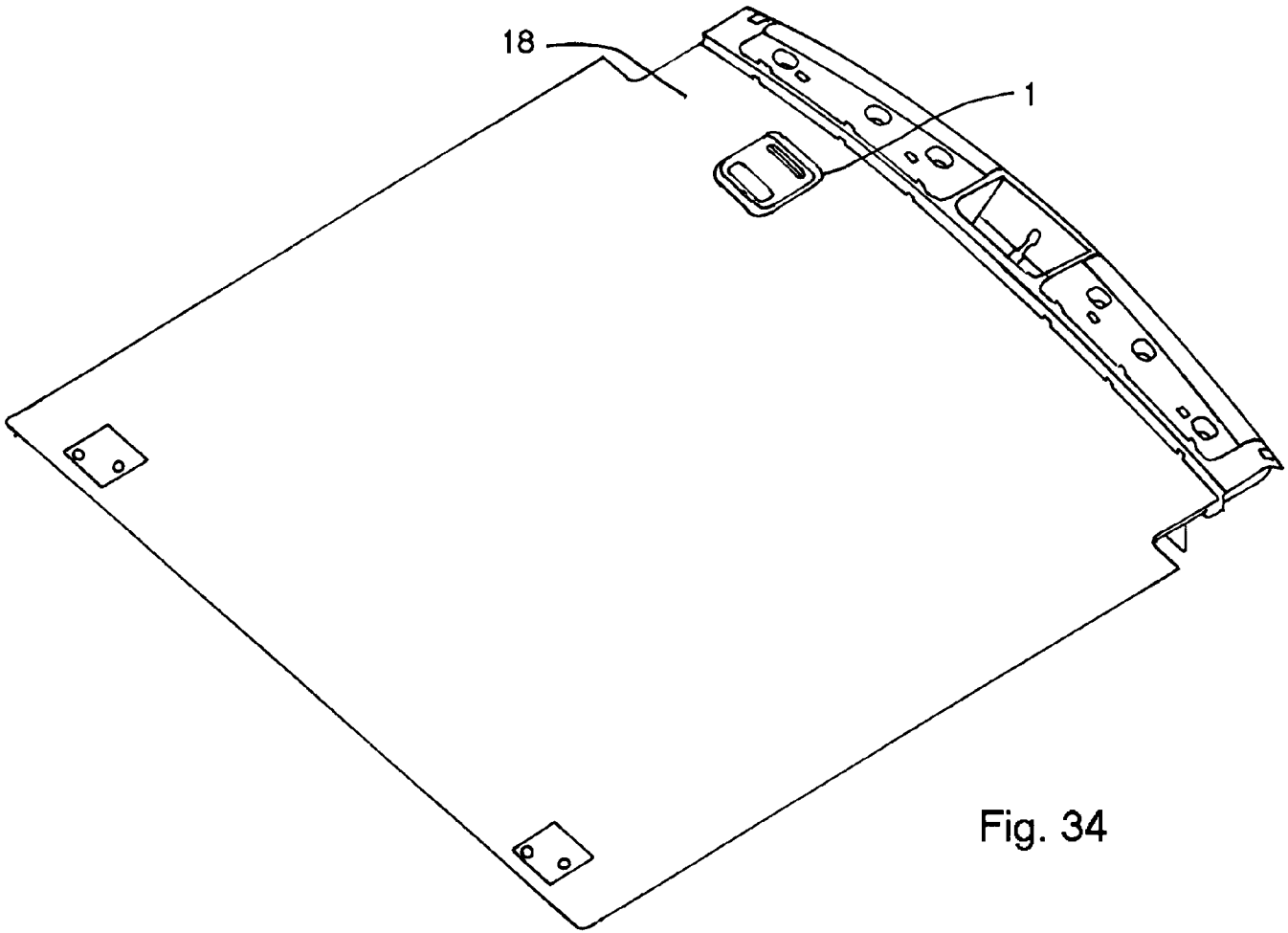
FIG. 34 is a top perspective view of the latch of FIG. 1 after the latch has been inserted into the first closure member.

To install the assembled latch 1, the latch can be lowered into a first closure member aperture 23 in the first closure member 18 which is a loadfloor panel in FIG. 30. Two snap legs 9 which are mounted at the front on the sides of the housing 3 will snap out once the latch 1 is pushed into the aperture 23 in the first closure member 18 as seen in FIGS. 31 & 32. The latch 1 can be permanently secured into a panel (not shown) using two thread forming screws (not shown) and washers. The screw bosses 16 can be seen from the underside of the first closure member 18 for assembly as shown in FIG. 33. FIG. 34 shows the top of the first closure member 18, here shown as a loadfloor panel. In the alternative, in place of two thread forming screws, bolts can be used with nuts captive to the housing.

Figure 36B:
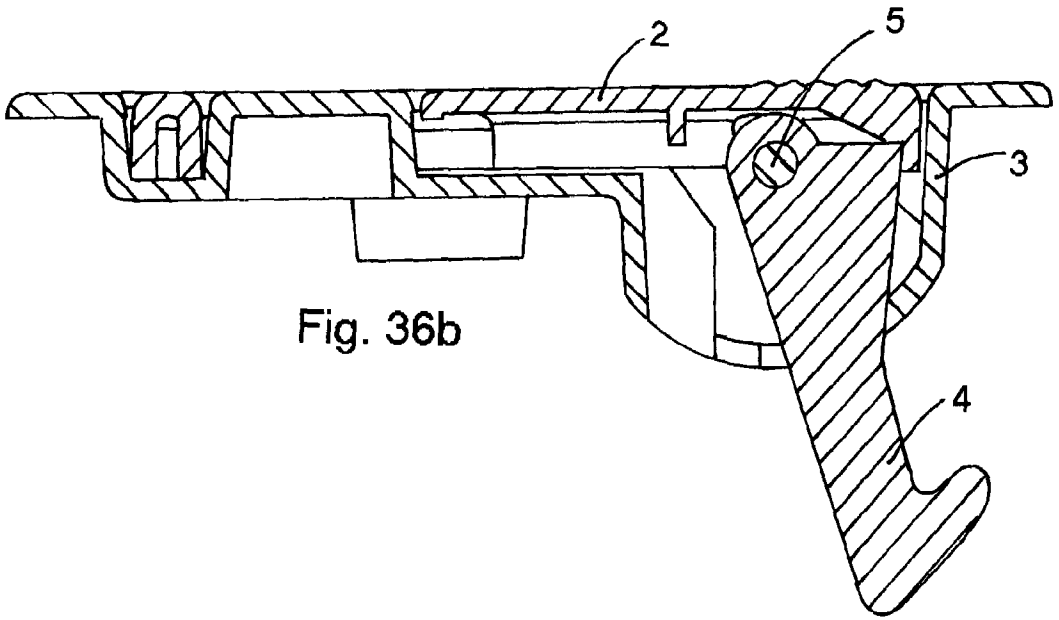

Operation of the latch 1 according to a first embodiment of the present invention as seen in FIGS. 36 and 36*b* is described below. The latch handle 2 is pressed down by a user, preferably by the users hand at the ribbed portion 11. When the latch 1 is initially rotated, the pawl 4 starts to rotate in turn by the actuation of the handle 2 on the pawl 4. In this embodiment of the present invention, the handle 2 and the pawl 4 rotate the same amount. For example, when the handle rotates 40 degrees the pawl rotates 40 degrees as seen in FIGS. 37 and 38.

When the latch handle 2 of the first embodiment is released, the pawl 4 rotates back to a closed position and the handle 2 also rotates back to a closed position which is also an at rest position. In addition, if the pawl 4 does not rotate back to the closed position fully, then the handle 2 will still close completely due to forces acting on the handle 2 by the handle spring 13 which is preferably a torsion spring. Finally, the pawl 4 can be rotated independently of the handle 2. An example of the advantage of the pawl 4 being able to rotate independently of the handle 2 occurs when a user who has opened the latch 1 from an initially closed and latched position wherein the pawl 4 of the latch 1 was engaged with a keeper 7 then seeks to release or let go of the latch when the latch 1 is in an unlatched position. When the users lets go of the latch handle 2, the latch 1 can be slammed shut since the pawl 4 can move freely even though the user has released the latch handle 2 and the action of the handle spring 13 has moved the handle 2 to the closed position. Due to the presence of handle spring 13, the handle 2 will remain under spring tension regardless of whether the pawl 4 returns to the fully forward closed position. The latch 1 therefore can accommodate for different tolerances due to the different applications which the latch 1 is used in and thereby the latch can also accommodate for different positional tolerances. FIG. 39*c* shows the latch 1 of the first embodiment with the pawl 4 engaging a keeper 7. In order for latch 1 to allow for a variety of different configuration of keepers and first closure members, the shape of the pawl of the latch and the position of the latch itself can be varied. For example, the latch and keeper configuration shown in FIG. 39*c* can accommodate a load floor having a variety of different thicknesses of carpet on the load floor and the latch will be able to operate effectively.

In another version of the present invention, the latch can be configured such that the handle can rotate about 20 degrees prior to the actuating of the pawl by the handle such that the total rotation of the handle is 60 degrees while the total rotation of the pawl is only 40 degrees.

In the third version of the present invention, the latch can be assembled without a handle torsion spring such that any rotation of the handle such as by 40 degrees would result in a rotation of the pawl by 40 degrees. In this version, if the pawl does not return to the closed position then there is no biasing force acting upon the handle to return the handle to the closed position.

A second embodiment of the latch of the present invention is shown in FIGS. 41–43, views of a first embodiment of a latch 101 of the present invention shown with a housing 103 and handle 102.

The handle as shown in FIGS. 44–46 has a ribbed gripping portion 111 which provides traction for a user who operates the handle 102. The handle has a boss 112 on opposite sides of the handle 102. The handle 102 also has posts 131 which provide a location to fit up to any electroplating equipment if it is desired to electroplate the latch handle 102. On each side of protuberance notch 135 is a handle protuberance surface 132 which contacts pawl 104 during contact of the handle protuberance surfaces 132 against the pawl 104 as seen in FIGS. 67 and 70. Also shown are spring leg guides 133 on both sides of spring leg holder notch 134 which together form first handle spring leg holder 136 which engages a leg of handle spring 113 as seen in FIG. 66.

The housing 103 as shown in FIGS. 47–49 has housing aperture 115 through which pawl 104 of FIGS. 51 and 52 projects. Each boss 112 of the handle 102 fits through a respective housing hole 117 when the latch 1 is assembled. In the top view of the housing 103 seen in FIG. 47, ribs 108 extend from one side of the housing 103 to an interior portion of the housing 103. Bosses 116 seen in FIG. 48 in the housing 103 are preferably threaded for a screw or bolt (not shown) to be inserted and provide a means for attaching the assembled latch 101 to a first closure member through which the screw or bolt is inserted. Second handle spring leg holder 139 on the interior of the housing which holds one of the handle torsion spring legs is seen in FIGS. 47 and 55. Bumper 140 which is fitted to bumper aperture 141 is seen in FIG. 57. The bumper 140 serves the function of minimizing rattling and vibration of the latch handle 102 by applying a biasing force on handle spring 113. The handle in turn rests against the bumper 140 when the handle 103 is at rest in the closed position. Outer housing guide ribs 142 provide a surface against which pawl projection 110 travels during pivoting of the pawl 104 as seen in FIG. 66.

FIGS. 50–52 show pawl core 144 prior to being overmolded by plastic. An overmolded pawl 104 having a T-shaped pawl projection 110 mounted therein is shown. The pawl 104 can be in the shape of a hook as shown in order to more positively engage a keeper 107 such as is shown in FIG. 67. The pawl core 104 is preferably steel which is overmolded with plastic to form pawl 104. Gussets 119 under pawl projection 110 provide support against any forces on the pawl projection 110 in the direction of the gussets 119. Pawl spring leg holder 145 engages a leg of the pawl torsion spring 114.

The latch 101 is assembled as described below. Handle spring 113 fits onto pin 105 and pawl spring 114 fits onto pawl 104 as seen in FIG. 55 when the latch 101 is assembled. After the pin 105 is inserted in the housing 103, pawl 104 can move independently of the pin 105. The pawl double torsion spring 114 is assembled over the pawl 104. The pin 105 is inserted through aperture 146 in the pawl 104. Pawl 104 and pawl spring 114 are free to rotate about the pin 105 as seen in FIG. 57. The handle spring 113 is placed onto the pin 105 as seen in FIG. 55 and the spring legs of the handle spring 113 are preferably formed such that the legs of the handle spring 113 are placed under spring tension and rotated in the keeper direction keeper prior to inserting the pin 105, pawl 104, and pawl spring 114 into indentations 120.

The pin 105, which is inserted in pawl 104, and pawl spring 1114 and handle spring 113 which are mounted on pin 105 can be aligned with indentations 120 in ribs 108 of the housing 103 which can be molded into the housing 103 as seen in FIGS. 55 and 57. The pin 105 along with pawl 104, pawl spring 114 and handle spring 113 can be lowered into the housing 103. The pawl 104 is preferably rotated about the pin 105 to allow the T-shaped pawl projection 110 to go through the housing aperture 115 in the bottom of the housing 103 as seen in FIG. 47.

While lowering the pin 105, pawl 104, pawl spring 114 and handle spring 113 into the housing 103, the pawl double torsion spring legs will be biased such that pre-compression occurs. The pin 105 is snapped into the housing 103 by a snap fit connection against housing pin snap legs 121 which preferably have dimple 147 as shown in FIG. 55. The dimples 147 assist in inserting pin 105 in housing pin snap legs 121 and thereby prevent permanent deformation of the housing pin snap legs 121.

Snap legs 122 and housing ribs 108 retain the pin 105. The two housing pin snap legs 121 (one at either of the ends of the pin) constrain any lateral pin movement as seen in FIG. 57.

As seen in FIGS. 55 and 57, the latch further comprises exterior housing snap legs 109 on an exterior surface of the housing 103, the exterior housing snap legs 109 being substantially flexible and providing a snap fit connection which connects the first closure member to the latch 101.

Preferably, each of the exterior housing snap legs 109 has an upper surface 129 facing in the direction of the handle. The upper surface 129 engages the first closure member 118 seen in FIGS. 60 and 63, and the upper surface 129 is angled upwardly in the direction toward the handle 102 in the direction of the housing 103.

In FIG. 59, the final component, the handle 102 is assembled by aligning handle 102 with housing 103. An assembler inserts one boss 12 on one side of the handle 102 into corresponding hole 117 in housing 103 as shown in FIG. 59. Finally, the handle 102 is pushed down to snap the second boss 112 into the housing hole 117 as seen in FIG. 60.

To install the assembled latch 101, the latch 101 can be lowered into a first closure member 118 which is a loadfloor panel in FIG. 63. Two exterior housing snap legs 109 which are mounted at the front on the sides of the housing 103 will snap outwardly relative to the housing once the latch 101 is pushed into the first closure member 18 as seen in FIG. 63. The latch 101 can be permanently secured into a panel (not shown) using two thread forming screws (not shown) and washers. The screw bosses 116 can be seen from the underside of the first closure member 18 for assembly as shown in FIG. 60. In the alternative, in place of two thread forming screws, bolts can be used with nuts captive to the housing.

Operation of the latch 101 according to the second embodiment of the present invention as seen in FIGS. 64 and 65 is described below. The latch handle 102 is pressed down by a user, preferably by the users hand at the ribbed portion 111. After the latch 101 is pivoted or rotated through an arc, the pawl 104 starts to pivot in turn by the engagement of the handle 102 on the pawl 104 as seen in FIGS. 68 to 70. In this embodiment of the present invention, the handle 102 pivots or rotates preferably 26 to 29 degrees before the handle 104 engages the pawl 104.

When a user has rotated handle 102 to its fully open position as seen in FIGS. 68 to 70, handle edge 152 seen in FIG. 46 engages interior rib stops 150 and pivot stops 151 seen in FIGS. 55 and 57 and thereby prevents further rotation of the handle past the handle position shown in FIGS. 68–70.

When the latch handle 102 of the second embodiment is released, the pawl 104 rotates back to a closed or latched position due to the forces of the pawl spring 114 and the handle 102 also rotates back to a closed position which is also an at rest position. In this embodiment, pawl stop 149 on the exterior of the housing prevents pivoting of the pawl 104 past the pawl stop 149 by the contact of pawl projection 110 on the pawl stop 149 as seen in FIG. 64.

In addition, if the pawl 104 does not rotate back to the closed position fully, then the handle 102 will still close completely due to forces acting on the handle 102 by the handle spring 113 which is preferably a torsion spring. Finally, the pawl 104 can be rotated independently of the handle 102. An example of the advantage of the pawl 104 being able to rotate independently of the handle 102 occurs when a user who has opened the latch 101 from an initially closed and latched position wherein the pawl 104 of the latch 101 was engaged with a keeper 107 then seeks to release or let go of the latch when the latch 1 is in an unlatched position. When the user lets go of latch handle 102, latch 101 can be slammed shut because pawl 104 can move freely, even though the user has released latch handle 102 and the action of the handle spring 113 has moved the handle 102 to the closed position. Due to the presence of handle spring 113, the handle 102 will remain under spring tension regardless of whether the pawl 104 returns to the fully forward closed position. The latch 101 therefore can accommodate for different tolerances due to the different applications which the latch 1 is used in and thereby the latch 101 can also accommodate for different positional tolerances. FIG. 67 shows the latch 101 with pawl 104 engaging keeper 107. In order for latch 101 to allow for a variety of different configuration of keepers and first closure members, the shape of the pawl of the latch and the position of the latch itself can be varied. For example, the latch 101 and keeper 107 configuration shown in FIG. 67 can accommodate a load floor having a variety of different thicknesses of carpet on the load floor and the latch will be able to operate effectively.

It will be recognized by those skilled in the art that changes may be made by the above-described embodiments of the invention without departing from the broad inventive concepts thereof. For example, each of the features described above do not all need to be included in a single device. Rather, one or more features can be provided in a single device where desired and in any combination. It is understood, therefore, that this invention is not limited to the particular embodiment disclosed, but it is intended to cover all modifications which are within the scope and spirit of the invention.

What is claimed is:

1. A latch for releasably securing a first closure member to a keeper on a second closure member in a latched position, said latch comprising:

a housing adapted for being received in an aperture formed in the first closure member, said housing having an interior surface and an opposed exterior surface and an opening extending therebetween;

a handle pivotally attached to said housing and moveable between an open position and a closed position, a handle biasing means, said handle being biased to the closed position by said handle biasing means;

a pawl support means connected to said housing;

a pawl on said pawl support means, said pawl being pivotable about said pawl support means between a latched position and an unlatched position, said pawl projecting through said opening and said pawl having a pawl projection at the exterior surface of the housing;

a pawl biasing means on said pawl support means, said pawl being biased toward said latched position by said pawl biasing means;

whereby pivotal movement of said handle to said open position pivots said pawl to said unlatched position and disengages said pawl from the keeper and said pawl projection moves along a portion of said exterior surface of said housing such that pivoting of the pawl is guided in said opening by said portion of said exterior surface of said housing during pivoting of said pawl.

2. The latch of claim 1 wherein a portion of said handle has an actuator which engages said pawl and pivots said pawl to the unlatched position and disengages said pawl from the keeper.

3. The latch of claim 2 wherein said pawl support means is a pin, said pin being provided on said housing and being rotatable in said housing about about an axis of said pin.

4. The latch of claim 3 wherein said housing has a pin support means, said pin support means supporting said pin and preventing movement of said pin along said axis of said pin.

5. The latch of claim 4 wherein said handle biasing means is a first torsion spring mounted on said pin and said pawl biasing means is a second torsion spring mounted on said pin.

6. The latch of claim 1 wherein said latch further comprises a pawl stop on said exterior surface of said housing, said pawl stop preventing pivoting of said pawl past said pawl stop.

7. The latch of claim 6 wherein said portion of said exterior surface of said housing of said latch along which said pawl projection moves has at least one outer guide rib having an edge and said pawl projection travels along said edge of said guide rib during pivoting of said pawl.

8. The latch of claim 1 wherein said latch further comprises a plurality of snap legs on said exterior surface of said housing, said snap legs being substantially flexible and providing a snap fit connection which connects said first closure member to said latch.

9. The latch of claim 8 wherein each of said snap legs has an upper surface facing in the direction of said handle, said upper surface for engaging said first closure member, said upper surface being angled toward said handle in the direction of said housing.

10. The latch of claim 1 wherein said housing has housing holes and said handle has handle bosses, said handle bosses being mounted in said housing holes of said latch thus permitting said handle to pivot in said housing.

11. The latch of claim 1 wherein said handle pivots through an arc prior to said handle pivoting said pawl to the unlatched position.

12. The latch of claim 11 wherein said handle pivots through an arc 26 to 29 degrees prior to said handle pivoting said pawl to the unlatched position.

13. The latch of claim 1 wherein said housing has a bumper on an upper surface of said housing, said bumper being resilient and said bumper contacting said handle upon release of said handle and return of said handle to the closed position.

14. The latch of claim 1 wherein said handle has a handle protuberance surface which engages said pawl when said handle is pivoted in said housing.

15. A latch for releasably securing a first closure member to a keeper on a second closure member in a latched position, said latch comprising:

a housing adapted for being received in an aperture formed in the first closure member said housing having interior ribs;

a handle pivotally attached to said housing and moveable between an open position and a closed position, said interior ribs preventing further pivoting of said handle past the open position, a handle biasing means, said handle being biased to the closed position by said handle biasing means;

a pawl support means connected to said housing;

a pawl on said pawl support means, said pawl being pivotable about said pawl support means between a latched position and an unlatched position, a pawl biasing means on said pawl support means, said pawl being biased toward said latched position by said pawl biasing means;

whereby pivotal movement of said handle to said open position pivots said pawl to said unlatched position and disengages said pawl from the keeper.

16. The latch of claim 15 wherein said housing further comprises at least one pivot stop on an interior corner of said housing which prevents further pivoting of said handle past the open position.

* * * * *